US006551654B1

(12) United States Patent
Branch et al.

(10) Patent No.: US 6,551,654 B1
(45) Date of Patent: Apr. 22, 2003

(54) APPARATUS AND METHOD FOR APPLYING COATING MATERIALS TO INDIVIDUAL SHEET MEMBERS

(75) Inventors: Don Everett Branch, Neuilly sur Seine (FR); Bernard Raymond Pierre, Monneville (FR)

(73) Assignee: 3M Innovative Properties Company, St. Paul, MN (US)

( * ) Notice: Subject to any disclaimer, the term of this patent is extended or adjusted under 35 U.S.C. 154(b) by 1331 days.

(21) Appl. No.: 08/950,524

(22) Filed: Oct. 14, 1997

Related U.S. Application Data

(62) Division of application No. 08/675,857, filed on Jul. 5, 1996, now abandoned, which is a continuation-in-part of application No. 08/291,610, filed on Aug. 17, 1994, now abandoned, and a continuation-in-part of application No. 08/615,587, filed on Mar. 12, 1996, now abandoned, which is a continuation of application No. 08/291,628, filed on Aug. 17, 1994, now abandoned.

(30) Foreign Application Priority Data

| | | |
|---|---|---|
| Feb. 16, 1996 | (GB) | 9603281 |
| Feb. 16, 1996 | (GB) | 9603345 |
| Feb. 16, 1996 | (GB) | 9603355 |
| Feb. 16, 1996 | (GB) | 9603365 |
| Feb. 16, 1996 | (GB) | 9603366 |

(51) Int. Cl.[7] ..... B05D 1/28; B05D 1/36; B05D 3/02

(52) U.S. Cl. ..... 427/208; 427/208.4; 427/208.8; 427/211; 427/286; 427/395; 427/411; 427/428

(58) Field of Search ..... 427/208, 208.7, 427/208.8, 211, 286, 395, 411, 428; 118/224, 225, 226, 227, 500, 642, 68, 258, 245, 249, 236, 239; 271/184, 185, 186, 216, 151; 270/58.33

(56) References Cited

U.S. PATENT DOCUMENTS

| | | | |
|---|---|---|---|
| 1,781,877 A | 11/1930 | Levin | |
| 2,060,800 A | 11/1936 | Ehrig et al. | 271/28 |
| 2,130,605 A | 4/1938 | Staude | 427/202 |
| 2,146,945 A | 2/1939 | Ehrig et al. | 271/12 |

(List continued on next page.)

FOREIGN PATENT DOCUMENTS

| | | |
|---|---|---|
| DE | 590 293 | 3/1935 |
| DE | 976 092 | 2/1963 |
| DE | 15 94 309 | 9/1969 |

(List continued on next page.)

OTHER PUBLICATIONS

"Coating Methods," vol. 3, p. 765–792, undated.
"Coating," No. 171, p. 23–33, 1986.
"Heating with Radio Waves," p. 2–6, Sep. 1973.

(List continued on next page.)

*Primary Examiner*—Michael Barr
(74) *Attorney, Agent, or Firm*—Carolyn V. Peters

(57) ABSTRACT

Sheets to be coated with water-based coating material, for example a primer and a low adhesion backsize, are supplied from a feeder (1), in end-to-end overlapping relationship, to a dual coater (3) in which the sheets are coated individually on both sides. A sheet inserter (2) is provided, upstream of the dual coater, to insert sheets from a second supply into the sheets from the feeder (1). The dual coated sheets are dried as individual sheets or as a pseudo-web of overlapped sheets. The sheets are then overlapped, unless previously overlapped, and the direction of overlap changed, if necessary, to provide the trailing edge of each sheet on top of the leading edge of each succeeding sheet. The overlapped sheets are conveyed through an adhesive transfer station (7) where stripes (236) of at least partially dried adhesive are coated onto the dual coated sheets from a transfer belt (71).

12 Claims, 13 Drawing Sheets

U.S. PATENT DOCUMENTS

| | | | | | |
|---|---|---|---|---|---|
| 2,503,984 | A | | 4/1950 | Wuko | 156/566 |
| 2,647,463 | A | | 8/1953 | Ferrar | 101/419 |
| RE24,906 | E | | 12/1960 | Ulrich | 526/328.5 |
| 3,029,731 | A | | 4/1962 | Bussey et al. | 101/419 |
| 3,121,021 | A | | 2/1964 | Copeland | 428/219 |
| 3,257,226 | A | * | 6/1966 | Thwaites | 427/395 |
| 3,265,556 | A | | 8/1966 | Hungerford | 428/215 |
| 3,360,396 | A | | 12/1967 | Kennedy et al. | 427/375 |
| 3,407,084 | A | | 10/1968 | Heywood | 427/285 |
| 3,426,754 | A | | 2/1969 | Bierenbaum et al. | 604/307 |
| 3,467,060 | A | * | 9/1969 | Klebanow et al. | 118/236 |
| 3,523,846 | A | | 8/1970 | Muller | 156/78 |
| 3,565,728 | A | | 2/1971 | Alton | 156/566 |
| 3,575,134 | A | | 4/1971 | Quint | 118/122 |
| 3,590,452 | A | | 7/1971 | Macleod | 29/115 |
| 3,607,579 | A | | 9/1971 | Enskat et al. | 156/571 |
| 3,645,835 | A | | 2/1972 | Hodgson | 428/195 |
| 3,655,488 | A | | 4/1972 | Goldstein et al. | 156/380 |
| 3,676,184 | A | | 7/1972 | Spearin et al. | 117/68 |
| 3,677,788 | A | | 7/1972 | Zirnite | 428/181 |
| 3,691,140 | A | | 9/1972 | Silver | 526/240 |
| 3,722,878 | A | * | 3/1973 | Kistner | 271/31 |
| 3,857,731 | A | | 12/1974 | Merrill, Jr. et al. | |
| 3,861,351 | A | | 1/1975 | Bonwit et al. | 118/685 |
| 3,897,780 | A | | 8/1975 | Trousil | 604/344 |
| 3,934,066 | A | | 1/1976 | Murch | 428/248 |
| 4,024,679 | A | | 5/1977 | Rain et al. | 52/2.19 |
| 4,024,814 | A | | 5/1977 | Becker | 101/410 |
| 4,054,710 | A | | 10/1977 | Betsolas | 428/228 |
| 4,068,615 | A | | 1/1978 | LeNir | 118/6 |
| 4,112,177 | A | | 9/1978 | Salditt et al. | 428/315.9 |
| 4,163,822 | A | | 8/1979 | Walter | 428/317.3 |
| 4,165,404 | A | | 8/1979 | Quehl | 428/212 |
| 4,166,152 | A | | 8/1979 | Baker et al. | 428/522 |
| 4,193,178 | A | | 3/1980 | McArthur et al. | 29/129.5 |
| 4,202,925 | A | | 5/1980 | Dabroski | 428/219 |
| 4,214,743 | A | | 7/1980 | Meier | 271/182 |
| 4,219,376 | A | | 8/1980 | Roman | 156/209 |
| 4,325,321 | A | | 4/1982 | Wahnschaff | 118/245 |
| 4,327,153 | A | | 4/1982 | Micheron | 428/421 |
| 4,328,064 | A | | 5/1982 | Miller, Jr. et al. | |
| 4,407,867 | A | | 10/1983 | Bruck et al. | 427/365 |
| 4,413,562 | A | | 11/1983 | Fischer | 101/408 |
| 4,416,448 | A | | 11/1983 | Meier | 270/55 |
| 4,427,737 | A | | 1/1984 | Cilento et al. | 428/315.7 |
| 4,442,162 | A | | 4/1984 | Kuester | 428/245 |
| 4,495,318 | A | | 1/1985 | Howard | 524/375 |
| 4,526,362 | A | * | 7/1985 | Thierstein | 271/186 |
| 4,537,650 | A | | 8/1985 | Coons, Jr. | |
| 4,558,888 | A | | 12/1985 | Hanson et al. | 281/23 |
| 4,566,014 | A | | 1/1986 | Paranjpe et al. | 346/1.1 |
| 4,598,112 | A | | 7/1986 | Howard | 524/78 |
| 4,612,074 | A | | 9/1986 | Smith et al. | 156/85 |
| 4,698,110 | A | | 10/1987 | Vassilios | 156/231 |
| 4,764,402 | A | | 8/1988 | Pagendarm et al. | 427/355 |
| 4,798,201 | A | | 1/1989 | Rawlings et al. | 602/52 |
| 4,805,552 | A | | 2/1989 | Pagendarm et al. | 118/325 |
| 4,822,670 | A | * | 4/1989 | Ono et al. | 428/317.3 |
| 4,883,209 | A | | 11/1989 | Hebels | 226/92 |
| 4,886,564 | A | | 12/1989 | Pagendarm et al. | 156/230 |
| 4,886,680 | A | | 12/1989 | Tindall | 427/8 |
| 4,904,425 | A | | 2/1990 | Hebels et al. | 264/40.1 |
| 4,967,740 | A | | 11/1990 | Riedel | 602/44 |
| 4,973,040 | A | | 11/1990 | Kemp et al. | 271/277 |
| 4,973,513 | A | | 11/1990 | Riedel | 428/252 |
| 5,009,408 | A | * | 4/1991 | Pulskamp | 270/57 |
| 5,029,832 | A | | 7/1991 | Orsinger et al. | 270/54 |
| 5,032,460 | A | | 7/1991 | Kantner et al. | 428/447 |
| 5,045,569 | A | | 9/1991 | Delgado | 521/60 |
| 5,067,699 | A | | 11/1991 | Gadway et al. | 270/55 |
| 5,085,167 | A | | 2/1992 | Hebels | 118/65 |
| 5,168,639 | A | | 12/1992 | Hebels | 34/13 |
| 5,179,908 | A | | 1/1993 | Hebels | 118/68 |
| 5,202,190 | A | | 4/1993 | Kantner et al. | 428/447 |
| 5,212,877 | A | | 5/1993 | Onur et al. | 34/29 |
| 5,378,281 | A | * | 1/1995 | Kamata | 118/264 |
| 5,409,208 | A | | 4/1995 | Schmid | 271/204 |
| 5,421,259 | A | | 6/1995 | Shiba et al. | 101/232 |
| 5,487,780 | A | * | 1/1996 | Ritter | 118/231 |

FOREIGN PATENT DOCUMENTS

| | | | |
|---|---|---|---|
| DE | 15 94 060 | 7/1970 | |
| DE | 17 52 337 | 5/1971 | |
| DE | 24 17 312 | 10/1974 | |
| DE | 24 25 130 | 12/1975 | |
| DE | 76 10 712 | 4/1976 | |
| DE | 28 36 319 | 3/1979 | |
| DE | 40 35 091 | 11/1980 | |
| DE | 31 21 992 | 12/1982 | |
| DE | 32 19 094 | 11/1983 | |
| DE | 34 17 746 | 11/1985 | |
| DE | 36 28 784 | 8/1986 | |
| DE | 36 32 816 | 9/1986 | |
| DE | 36 06 199 | 8/1987 | |
| DE | 37 41 680 | 12/1987 | |
| DE | 38 02 797 | 3/1990 | |
| DE | 40 13 776 | 4/1990 | |
| EP | 0 070 524 | 7/1982 | |
| EP | 0 163 127 | 12/1985 | |
| EP | 0 270 833 | 11/1987 | |
| EP | 0 395 295 | 10/1990 | B41F/17/00 |
| EP | 0 439 941 | 8/1991 | |
| EP | 0 455 615 | 11/1991 | |
| FR | 2 568 146 | 7/1984 | |
| GB | 2 004 773 | 9/1978 | |
| GB | 2 034 203 | 6/1980 | |
| GB | 2 089 687 | 6/1982 | |
| GB | 2 166 717 | 11/1984 | |
| GB | 2 243 313 | 4/1991 | |
| GB | 2 248 412 | 9/1991 | |
| JP | 49-111436 | 6/1973 | |
| JP | 49-112819 | 7/1973 | |
| JP | 50-79534 | 6/1975 | |
| JP | 52-52936 | 4/1977 | |
| JP | 52-123437 | 10/1977 | |
| JP | 56-30481 | 2/1981 | |
| JP | 57-12084 | 1/1982 | |
| JP | 57-78471 | 5/1982 | |
| JP | 57-115479 | 7/1982 | |
| JP | 58-53975 | 3/1983 | |
| JP | 58-167667 | 4/1983 | |
| JP | 58-96670 | 5/1983 | |
| JP | 58-174484 | 10/1983 | |
| JP | 58-222170 | 12/1983 | |
| JP | 59-176376 | 10/1984 | |
| JP | 61-10 | 12/1985 | |
| JP | 60-248786 | 12/1985 | |
| JP | 4-14434 | 1/1992 | |
| JP | 52-89138 | 11/1993 | |
| JP | 60-26077 | 2/1994 | |
| TW | 64 11547 | 3/1974 | |
| TW | 69 13302 | 10/1979 | |
| TW | 70 11019 | 5/1980 | |
| TW | 71 11864 | 7/1981 | |
| TW | 71 13269 | 8/1981 | |
| TW | 72 11663 | 5/1983 | |
| TW | 72 12276 | 10/1983 | |
| TW | 72 13834 | 11/1983 | |
| TW | 72 14566 | 12/1983 | |
| TW | 76 105671 | 4/1985 | |
| TW | 74 104215 | 8/1985 | |

| | | |
|---|---|---|
| TW | 74 105175 | 11/1985 |
| WO | WO 87/05315 | 9/1987 |
| WO | WO 94/19419 | 9/1994 |
| WO | WO 96/05065 | 2/1996 |
| WO | WO 96/05066 | 2/1996 |

OTHER PUBLICATIONS

"Physics Part I and II, Combined Third Edition," 1966.
"Thermoplastic Polyamide Adhesives," p. 92–97, 1987 (with abstract).
"What you should know about Industrial Microwave Processing," p. 1–20, 1981, 1987.
1985 Polymers, Laminations & Coatings Conference, "New Advances in High Performance Water Based Pressure Sensitive Adhesives," p. 469–475.
Adhesion, "Adhesive Label Sheet," vol. 28, No. 10, p. 21–26, 1984.
Adhesion, "Latex PSA Coating," vol. 27, No. 3, p. 30–33, 1983.
Adhesion, "Testing of Self–Adhesive Dispersions with Applied Amount as Parameter," p. 16–18, 1986.
Adhesives Age, "Drying Waterborne PSAs," p. 44–47, Sep. 1984.
Adhesives Age, "Formulation and Performance of Water–Based PSAs," p. 29–32, Sep. 1984.
Journal of Adhesion and Sealing,"Adhesion and Adhesives," vol. 30, No. 2, 1986.
Journal of Adhesion and Sealing, "Adhesive Sheets," vol. 28, No. 2, 1984 (with abstract).
Journal of Adhesion and Sealing, "Development of Water Borne PSAs," vol. 28, No. 2, Apr. 1980 (with abstract).
Journal of Adhesion and Sealing, "Outlook on PSA and Coating Costs," Jun. 1980.
Journal of Adhesion and Sealing, "Problems of Water Borne PSAs," vol. 29, No, 11, 1985 (with abstract).
Journal of Adhesion and Sealing, "PSAs and Line Coating," vol. 28, No. 4, 1984.
Journal of the Adhesion Society of Japan, "Physical Properties of Pressure Sensitive Adhesive Tape," vol. No. 6, 1980.
Journal of the Adhesion Society of Japan, "The Influence of Interfacial Force and Mechanical Properties of Coatings and Adhesion," vol. 20, No. 5, 1984.
Journal of the Adhesion Society of Japan, "The Survey of Pressure Sensitive Adhesive Technology," vol. 18, No. 8, 1982.
Kirk–Othmer Encyclopedia of Chemical Technology, "Coating Processes," p. 386–426, vol. 6, 1979.
Korber brochure, "Paper is our Passion," Apr. 1994.
Packaging, "Fifty Years Since the First Label," p. 32–33, Jun. 1985.
Pagendarm brochure, "Coating Heads," undated.
Pagendarm brochure, "Dryers," undated.
Paper Processing and Pressure, "Paper Converting and Printing," p. 1356–1360, 1985.
Plastics Age, "Present and Future of Adhesive Coating Technology," vol. 28, No. 6, Jun. 1982.
Pressure Sensitive Adhesives—Formulations and Technology, p. 158–159, undated.
Pulp and Paper Science and Technology, p. 412–421, undated.
Pulp and Paper, p. 1360–1361, undated.
Radio Frequency Co. product brochure, undated.
Strayfield product brochure, undated.
Svensk Paperstidning, "The Setting of Aqueous Adhesives on Coated Board," p. R23–R28, 1984.
Tappi Paper Synthetics Conference, "Meeting the Demands of the 80s with Water–Borne Laminating Adhesives," p. 175–180, Sep. 15–17, 1980.
Tappi, "Alternatives to Solvent–Borne Systems for Pressure–Sensitive Adhesives," p. 107–108, Jul. 1980.
Tappi, "The Setting of Aqueous Adhesives on Paper," p. 63–65, Dec. 1978.
Technology on Adhesion and Sealing,"Problems for Water PSAs," vol. 30, No. 2, 1986 (with abstract).
The Paper Specialists of the Korber Group brochure, undated.
William Brushwell Reports,"Coatings Update," 1981.
Int. J. Adhesion and Adhesives, "Focus on Pressure Sensitive Adhesives," p. 196–198, Jul. 1982.
Japan Society of Adhesion, "Dynamic Viscoelastic Measurements of Coating Films During the Drying Process" vol. 20, No. 11, 1984.
Handbook of Pressure–Sensitive Adhesive Technology, "Saturated Paper and Saturated Paper Tapes," p. 675–690, 1982.
Handbook of Pressure–Sensitive Adhesive Technology, "Silicone Release Coatings," Chapter 18, p. 384–403, 1982.
Handbook of Pressure–Sensitive Adhesive Technology, "Drying," p. 867–868, 1982.
Handbook of Pressure–Sensitive Adhesive Technology, p. 547–548, undated.
Converter, "Water–based Adhesives and Coatings for Packaging Applications," p. 18–22, Nov. 1976.
Converter, "Where are we at the Hotmelt Pressure–Sensitive Coated Label Stock?" p. 16–19, undated.
Canadian Packaging, "Custom Coaters," p. 22–23, Nov. 1984.
Converter, "Pressure Sensitive Adhesive Products for Industry—A real Opportunity for Profit Growth," p. 18–20, Sep. 1979.
Billhofer brochure, undated.
Billhofer brochure, 1986.
Adhesives Technology Handbook, "Adhesive Types and Their Properties and Applications," p. 183–185, 1985.
Advances in Adhesives: Applications, Materials and Safety, "Water–Based Adhesives: Past, Present and Future," p. 123–130, 1983.
Adhesives Age, "Overcoming Substrate Problems in Waterborne Laminating," p. 22–24, Feb. 1986.
Adhesives Age, "Rheological Characterization of Elastomer Latexes for PSAs," p. 24–28, Sep. 1986.

* cited by examiner

FIG. 16
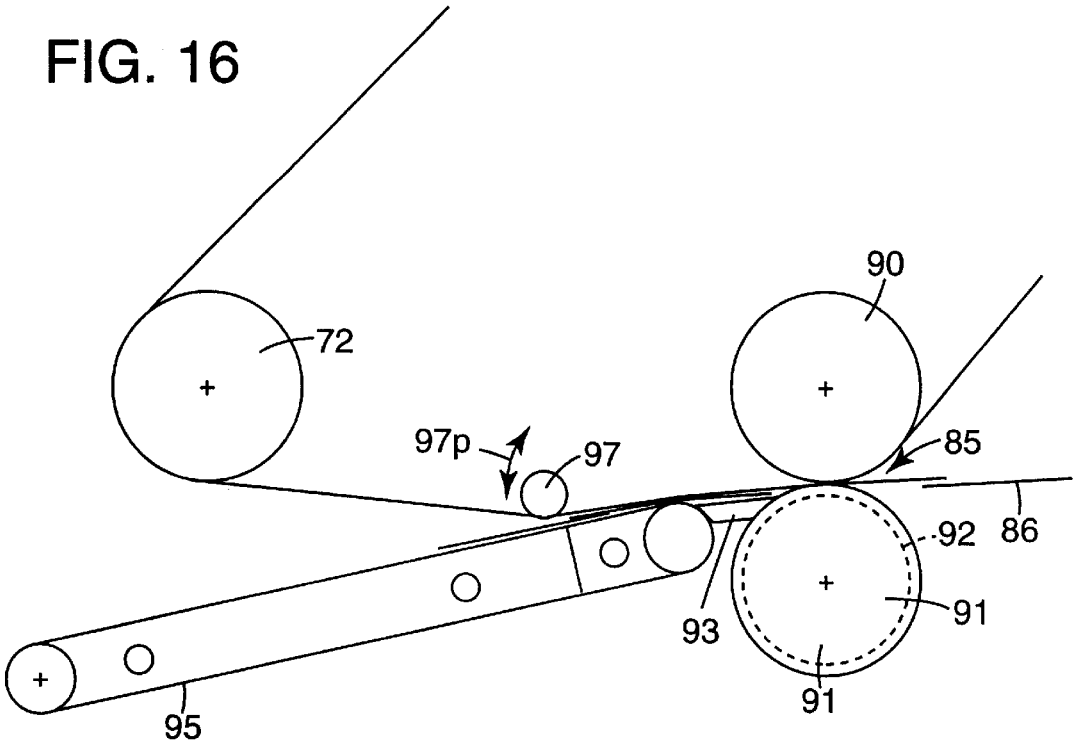
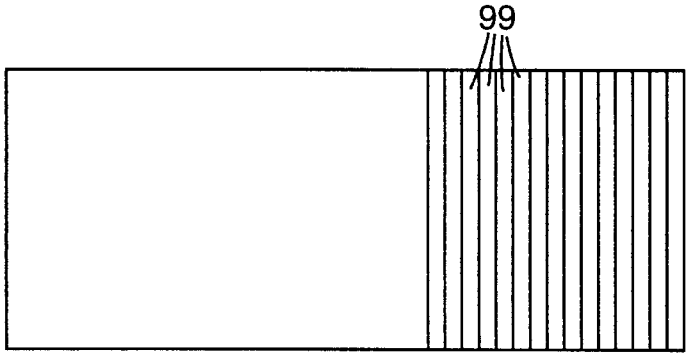
FIG. 19

APPARATUS AND METHOD FOR APPLYING COATING MATERIALS TO INDIVIDUAL SHEET MEMBERS

This is a divisional of U.S. patent application Ser. No. 08/675,857, filed Jul. 5, 1996, now abandoned which is a continuation-in-part of both U.S. patent application Ser. No. 08/291,610, filed Aug. 17, 1994, now abandoned, and U.S. patent application Ser. No. 08/615,587, filed Mar. 12, 1996, now abandoned which is a continuation of U.S. patent application Ser. No. 08/291,628, filed Aug. 17, 1994, now abandoned

FIELD OF THE INVENTION

The present invention relates generally to an apparatus and method for applying coating materials to a plurality of overlapped individual sheets, such as individual sheets of paper. A specific aspect of the invention relates to an apparatus and method for applying a coating material to both opposing major surfaces of a plurality of individual sheets.

BACKGROUND

It is often necessary to apply coating materials to paper and, in some cases, to apply different coating materials to both major surfaces of the paper. For example, in the production of repositionable notes, such as the Post-It® brand note pads available from Minnesota Mining and Manufacturing Company, it is known to apply a primer material to one side of the paper from which the repositionable notes will be cut, and to apply a low adhesion backsize, or release, material to the other side of the paper. Repositionable adhesive is then applied to the paper on top of the primer material. Conventionally, for the production of repositionable notes, the various coatings are applied to a web of paper drawn from a continuous roll. The coating materials are dispersed in solvents and coated directly onto the paper web. The web is dried between coatings and then rewound, with the coated roll subsequently cut into sheets which are used to produce the notes.

A process for the production of repositionable notes, in which a release material and a primer material are coated successively on opposite sides of a paper web, is described in WO-A-87/05315.

In some cases, it is desirable to apply coating material to cut sheets rather than to a continuous web of paper. For example, in the production of repositionable notes it is often desirable to have the option of using a stack of preprinted sheets as the supply source, instead of a plain paper web, to extend the flexibility of the production process. In addition, for environmental reasons, there is a desire to move away from the use of environmentally destructive organic solvents in such coating processes, and towards more environmentally friendly water-based materials. It is moreover noted that many inks are soluble in organic solvents, but insoluble in water.

WO 94/19419 discloses an apparatus and a method for forming pads of repositionable notes from a stack of uncoated individual paper sheets. The sheets are fed from the stack in an overlapped condition to a coating station in which a continuous layer of a water-based primer material is applied to one major surface of the pseudo web of overlapped sheets, and a continuous layer of a water-based low adhesion backsize (LAB) material is applied simultaneously to the other major surface. The overlapped sheets are then dried and fed to a second coating station in which stripes of repositionable adhesive are transferred from an endless transfer belt to the pseudo web of overlapped sheets onto the surface to which the primer was applied in the first coating station. Thereafter, the sheets are adhered together in a stack and trimmed to form pads of repositionable notes.

Coating of Individual Sheets

In certain coating processes, it may be preferable for sheets to be coated individually rather than in the form of an overlapped pseudo web. However, commercial coating stations are generally designed for coating a continues web of paper dispensed from a large roll, and cannot accommodate individual sheets.

Hence, efforts continue to develop a commercially viable system that will enable the coating of individual sheets with an effective amount of coating material.

Reversing Direction of Overlap

In certain circumstances, the handling of overlapped individual sheets can be facilitated by reversing the direction of the overlap as the sheets pass through certain segments of the coating process. When such a reversal in the direction of overlap is desired, the apparatus used to achieve the reversal should function reliably for a wide range of sheet sizes, weights and types.

It has been found that existing systems for applying a coating material to sheets, while having their own utility, are not as effective and flexible as desired. It has also been found that existing systems which use an endless transfer surface for applying a coating material to sheets commonly encounter problems in removing the sheets and the coating material from the transfer surface when certain types of coating materials and/or certain types and sizes of sheets are being coated. Therefore, an improved method and apparatus for applying coating materials onto sheets, including an improved method and apparatus for transferring a coating material from an endless transfer surface to sheets, is desired.

SUMMARY OF THE INVENTION

Inserting Secondary Sheets

The sheet inserter aspect of the present invention provides an apparatus and a method effective for periodically inserting a different secondary sheet into a sequence of overlapped sheets which are to be coated. The apparatus includes (i) a sheet feeder operable to sequentially feed primary sheets from a stack of primary sheets onto a conveyor in end-to-end overlapping relationship to each other, (ii) a sheet inserter operable to insert at least one secondary sheet, from a second stack, into the overlapped primary sheets on the conveyor, and (iii) a coater positioned to receive the overlapped sequence of primary and secondary sheets from the conveyor and operable to apply coating material to at least one major surface of each sheet.

The method comprises the ordered steps of: (a) feeding primary sheets from a first sheet stack onto a sheet path in end-to-end overlapping relationship to each other, (b) conveying the overlapped primary sheets along the sheet path, (c) inserting at least one secondary sheet, from a second sheet stack, into the overlapped primary sheets being conveyed along the sheet path, so as to form a sequence of primary and secondary sheets arranged in end-to-end overlapping relationship to each other, and then (d) applying a coating material to at least one major surface of each of the primary and secondary sheets in the sequence as the sheets continue to be conveyed along the sheet path.

Dual Coating of Individual Sheet Members

The dual coating aspect of the present invention provides an apparatus and a method for simultaneously applying a water-based coating material to both major surfaces of separated individual sheet members. The apparatus includes (i) a dual coating system positioned to sequentially receive single sheet members as the sheet members are conveyed along a sheet path, the coating system comprising first and second coating mechanisms located on opposed sides of the sheet path with each coating mechanism operable to apply a water-based coating material to a major surface of each sheet; (ii) a dryer positioned along the sheet path for removing water from the water-based coating materials applied to the sheets by the coating mechanism, (iii) means for arranging sheets as they exit from the drier in sequential end-to-end overlapping relation, and (iv) a secondary coating mechanism positioned along the sheet path which is effective for receiving the overlapped sheets and applying a secondary coating material to one side of the overlapped sheets.

The method comprises the ordered steps of: (a) sequentially feeding individual sheets from a first sheet stack onto a sheet path, (b) conveying the overlapped primary sheets along the sheet path, (c) applying a water-based coating material to a major surface of each individual sheet being conveyed along the sheet path, (d) drying the coated sheets while continuing to convey the sheets along the sheet path; (e) arranging the dried sheets in sequential end-to-end overlapping relationship to each other, and then (f) continuously applying a second coating material to at least one major surface of each of the arranged sheets as the sheets continue to be conveyed along the sheet path.

Padded Coating Drum

The covered coating drum aspect of the present invention provides an apparatus and a method for applying a coating material to at least one major surface of separated individual sheet members. The apparatus includes (i) a coating roller; (ii) a support sheet releasably secured over the surface of the coating roller, (iii) an elastomeric covering member adhesively secured to the support sheet which extends over only a portion of the circumference of the coating roller, (iv) a nip roller which cooperates with the coating roller to form a nip only with that portion of the coating roller which is covered with the covering member; (v) a source of coating material, and (vi) a means for applying coating material from the source of coating material to the covering member on the coating roller.

The method comprises the ordered steps of: (a) applying coating material from the source of coating material to the covering member on the coating roller, and (b) conveying individual sheets into the nip formed between the coating roller and the nip roller in such a manner that the sheet is registered and aligned with the covering member on the coating roller such that the coating material on the covering member is transferred to the sheet without being transferred to the nip roller.

Reversing Direction of Overlap

The overlap altering aspect of the present invention provides an apparatus and a method for reversing the direction in which the sheets are overlapped. The apparatus includes (a) a first conveyor means for transporting a succession of overlapped sheets wherein the trailing edge of each sheet is positioned underneath the leading edge of the succeeding sheet; (b) a second conveyor means arranged to receive sheets from the first conveyor means; and (c) an arrangement, positioned between the first and second conveyor means, effective for changing the relative overlapping positions of the sheets; whereby the sheets received by the second conveyor means are arranged with the trailing edge of each sheet positioned over the leading edge of the succeeding sheet. The arrangement effective for changing the relative overlapping positions of the sheets comprises (A) a blower for directing a current of air at the overlapped edges of each pair of sheets so as to move such edge portions away from the plane defined by the succession of sheets, and (B) a means for retarding the subsequent return of the trailing edge of the leading sheet so as to ensure that such trailing edge will consistently be deposited on top of the leading edge of the succeeding sheet.

A preferred embodiment of the overlap altering aspect of the invention positions the overlap altering arrangement between the dual coating system and the dryer of the dual coat aspect of the invention. In this embodiment, the sheets are coated one at a time in the dual coating system and then deposited on a first conveying means with the trailing edge of each sheet positioned underneath the leading edge portion of the succeeding sheet. As the overlapped sheets are transferred from the first conveying means to a second conveying means for transportation into the dryer, the overlap altering arrangement reverses the relative overlapping positions of the sheets whereby the trailing edge of each sheet is positioned on top of the leading edge portion of the succeeding sheet.

The method comprises the ordered steps of: (i) conveying a succession of overlapped sheets on a first conveying means, wherein the trailing edge of each sheet is positioned underneath the leading edge of the succeeding sheet; (ii) transferring the overlapped succession of sheets from the first conveyor means to a second conveyor means; and (iii) changing the relative overlapping positions of the sheets as the sheets are transferred from the first conveying means to the second conveying means so that the sheets received by the second conveyor means are arranged with the trailing edge of each sheet positioned over the leading edge of the succeeding sheet. The preferred means by which the relative overlapping positions of the sheets is changed includes the steps of (I) blowing a current of air at the overlapped edges of each pair of sheets so as to move such edge portions away from the plane defined by the succession of sheets, and then (II) retarding the subsequent return of the trailing edge of the leading sheet so as to ensure that such trailing edge will consistently be deposited on top of the leading edge of the succeeding sheet.

Detachment of Coated Sheets From a Transfer Surface

The sheet detachment aspect of the present invention provides an apparatus and a method for facilitating the consistent removal of overlapped sheets and coating material from a transfer surface used to transport coating material into contact with a pseudo-web of overlapped sheets. The sheet detachment apparatus is particularly useful in connection with a transfer system designed to transfer an at least partially dried coating material to a pseudo-web of overlapped sheets. Briefly, such a transfer system conveys a pseudo-web of overlapped sheets to a transfer location where an endless transfer surface, moving in the same direction and at the same speed as the pseudo-web, contacts a major surface of the conveyed sheets for purposes of transferring a coating material from the transfer surface to the sheets in the pseudo-web. The coating material is remotely applied to the transfer surface by a dispensing device which is capable of applying various types of coating materials at various thickness and variable patterns to the transfer surface.

The sheet detachment apparatus includes (a) a detachment conveyor located adjacent the path of the sheets leaving the transfer location; and (b) a source of reduced pressure operable for (A) providing an area of reduced pressure over a first length of the detachment conveyor, positioned closest to the transfer location, effective for detaching sheets from the transfer surface and attracting the sheets to the detachment conveyor and, (B) providing an area of reduced pressure over a second length of the detachment conveyor effective for keeping the sheets attached to the detachment conveyor as the sheets are moved away from the transfer location.

The method comprises the ordered steps of: (i) conveying a pseudo-web of overlapped sheets along a sheet path and through a transfer location, (ii) applying a coating material to the surface of an endless transfer surface, (iii) contacting a first major surface of the sheets in the pseudo web with the coated endless transfer surface as the sheets are conveyed through the transfer location, (iv) applying a partial vacuum to that portion of the conveyor positioned immediately downstream from the transfer location effective for detaching the sheets and coating material from the transfer surface and attracting the coated sheets to the conveyor, and (v) applying a partial vacuum to the balance of the conveyor positioned downstream from the transfer location effective for keeping the coated sheets attached to the conveyor as the sheets are moved away from the transfer location.

BRIEF DESCRIPTION OF THE DRAWINGS

FIG. 16 is an enlarged side view illustrating a portion of the adhesive transfer station shown in FIG. 15.

FIG. 19 is a diagrammatic plan view of an alternative sheet arrangement useful in operation of the apparatuses shown in FIGS. 1, 3 and 5.

DETAILED DESCRIPTION OF THE INVENTION INCLUDING A BEST MODE

Nomenclature

Figure 1:
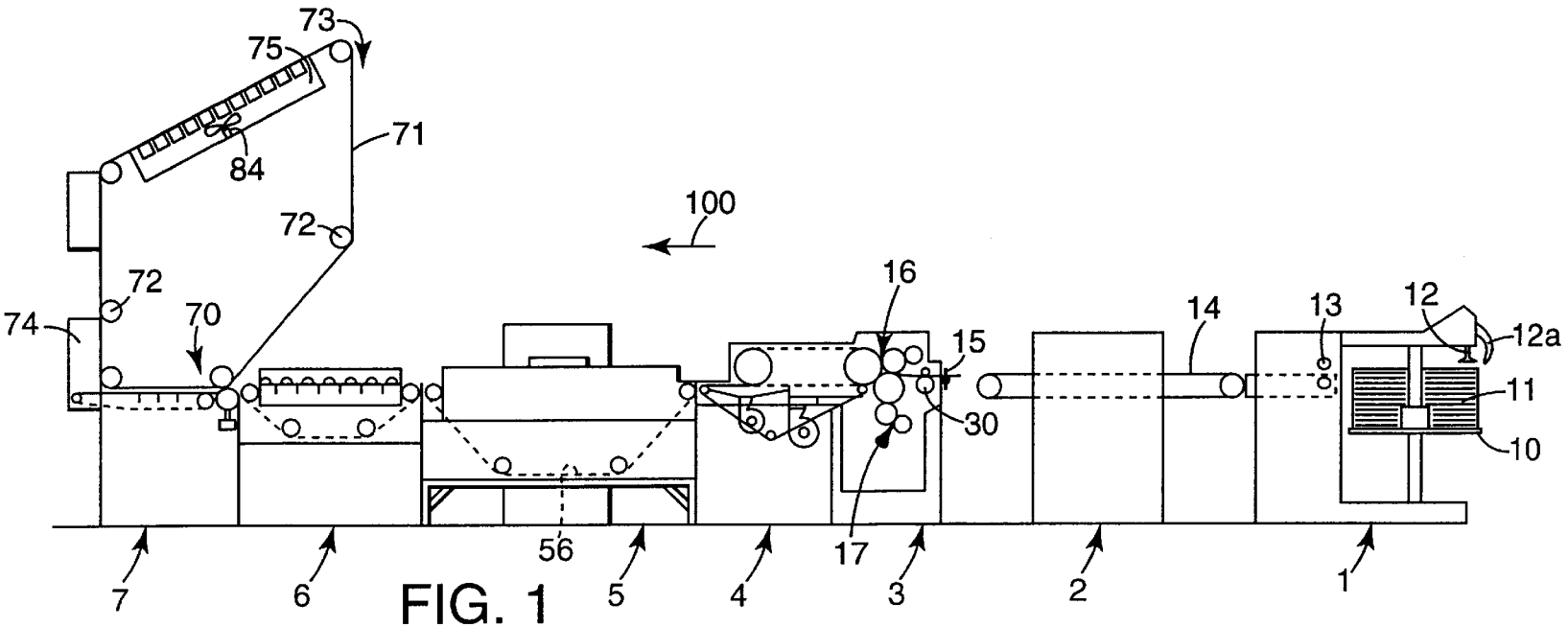
FIG. 1 is a schematic side view of one embodiment of the invention.

1 Sheet Feeding Station
2 Sheet Inserting Station
**2*a*** Insert Conveyor
**2*b*** Insert Sheet Feeder
3 Dual Coating Station
4 Sheet Spacing Station
5 Drying Station
6 Sheet Guiding Station
7 Adhesive Transfer Station
8 Sheet Overlapping Station
9 Sheet Stacking Station
10 Table
11 Stack of Sheets
12 Suction Head
**12*a*** Jet Nozzle
13 Paired Feed Rollers
14 First Conveyor
15 Stop Gate
16 Upper Coating System
17 Lower Coating System
20 Insert Sheet
21 Missing Sheet
22 Preceding Sheet
23 Succeeding Sheet
**25*a*** Gear Box
**25*b*** Two-Way Clutch
30 Nip Roll Pair
Upper Metering Roller
**31*t*** Upper Primer Trough
32 Upper Coating Roller
**32*c*** Upper Counter Roller
33 Coating Drum
34 Lower Metering Roller
**34*t*** Lower LAB Trough

35 Lower Coating Roller
35*c* Lower Counter Roller
36 Channel in Coating Drum
37 Sheet Gripper
38 Pad
38*a* Support Sheet
40 Upper Nozzles
41 Primer Supply Tank
42 Pump
43 Overflow Outlets
45 Lower Nozzles
46 LAB Supply Tank
47 Pump
48 Overflow Outlets
50 Clasping Unit
51 Second Conveyor
52 Clasp
53 Endless Chain
54 Blower
55 Low Pressure Source
56 Third Conveyor
60 Air Knife
61 Vacuum Cylinder
62 Ends of Vacuum Cylinder
63 Apertures Through Vacuum Cylinder
66 Vacuum Pump
67 Line Between Vacuum Cylinder and Vacuum Pump
68 Deflection Plate
70 Transfer Location
71 Transfer Belt
72 Tension Rollers
73 Direction of Transfer Belt Movement
74 Coating System
75 Adhesive Dryer
76 Transfer Surface
77 Gravure Roller
77*r* Gravure Rings
78 Pump
79 Adhesive Supply Tank
80 Adhesive Trough
81 Metering Roller
82 Doctor Blades
84 Exhaust Fan
85 Transfer Nip
86 Overlapped Sheets Passing Through the Adhesive Transfer Location
90 Drive Roller
91 Idler Counter-Pressure Roller
92 Grooves in Drive Roller
93 Fingers
94 Vacuum Box
94*a* Forward Chamber of Vacuum Box
94*b* Rear Chamber of Vacuum Box
94*x* Openings in Forward Chamber
94*y* Openings in Rear Chamber
95 Vacuum Belt
96 Standard Conveyor
97 Additional Roller
97*p* Pivot Line of Additional Roller
98 Apertures in the Vacuum Belt
99 Sheet Margin
100 Machine Direction
110 Input Rollers
111 Drive Rollers
112 Lever
113 Output Rollers
121 First Portion of a Split Apparatus
122 Second Portion of a Split Apparatus
130 Stack of Dual Coated and Dried Sheets
140 Stack of Adhesive Coated Sheets
150 Secondary Sheet Inserter
220*a* Base Layer of Transfer Belt
220*b* Front Major Surface of Base Layer
220*c* Back Major Surface of Base Layer
220*d* Front Release Layer
220*e* Back Release Layer
220*g* Indentations in Base Layer
220*h* Outermost Surface of Front Release Layer
220*i* Outermost Surface of Back Release Layer
220*j* Indentations in Release Layers
229 Smoothing Strips
230 Cells in Gravure Rings
230A Pattern Line of Cells in Gravure Rings
236 Adhesive Stripes
239 Vacuum Roller
242 Coating Die
245 Adhesive Supply Line
246 Pump
247 Filter

Definitions

As utilized herein, including the claims, the term "vacuum" means any pressure which is less than atmospheric and possessing sufficient attractive force to achieve the desired removal or retention of sheet members.

Construction

The Apparatus

The apparatus (unnumbered) is specifically designed for use in the production of repositionable notes (not shown) from sheets (unnumbered) of any suitable substrate material, for example, paper, polymeric film or foils, such as metallic foils and, in particular, for the application to individual sheets (unnumbered) of a primer material (not shown), a low adhesion backsize (LAB) material (not shown), and a repositionable adhesive (not shown) so that the sheets can subsequently be used to form repositionable notes. In the following description, it will be assumed, unless otherwise noted, that the sheets (which may be pre-printed) are of paper. The paper may be any suitable paper, such as the paper utilized to construct the Post-It® brand repositionable notes available from Minnesota Mining and Manufacturing Company ("3M") of St. Paul, Minn. When the sheets are formed of paper, the sheets are preferably transported through the apparatus with the machine direction (unnumbered) of the paper sheets running parallel to the machine direction 100 of the apparatus in order to reduce the tendency of the paper sheets to curl or wrinkle while being processed.

The First Embodiment

Figure 2:
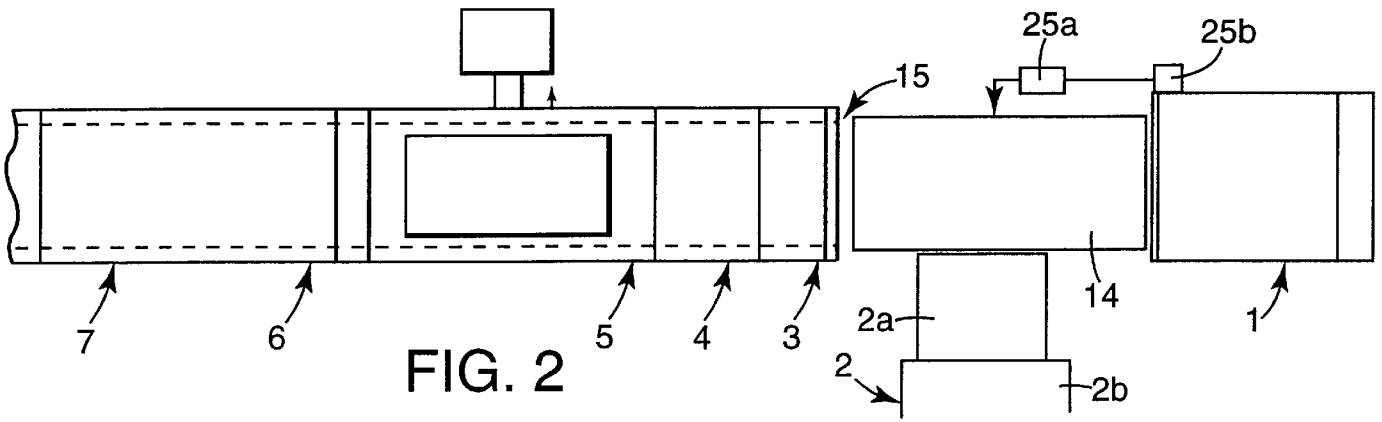
FIG. 2 is a schematic plan view of the apparatus shown in FIG. 1

As shown in FIGS. 1 and 2, a first embodiment of the apparatus includes a sheet feeding station 1 which delivers a succession of paper sheets (not shown) from a stack of sheets 11 onto a first conveyor 14 so as to initiate movement of paper sheets along a sheet path (unnumbered). From the sheet feeder 1, the sheets travel along the sheet path in a machine direction indicated by the arrow 100. The succession of sheets then sequentially travel (i) past a sheet inserting station 2 located to one side of the sheet path, (ii) through a dual coating station 3, (iii) through a sheet spacing station 4, (iv) through a drying station 5, (v) through a sheet guiding station 6, and (vi) an adhesive transfer station 7. Control and synchronization of sheet movement through the various stations (1 through 7) may be performed by a central electronic control unit (not shown), for example a Siemens PLC 135.

As described in greater detail below, when the sheet inserting station 2 is not in use, sheets leave the sheet feeding station 1 in a continuous stream in which, to reduce the space required between the sheet feeding station 1 and the dual coating station 3, the trailing edge (unnumbered) of each preceding sheet 22 overlapping the leading edge (unnumbered) of the succeeding sheet 23. The sheets are, however, conveyed separately through the dual coating station 3 where they are coated individually on one major surface (unnumbered) with a primer material, and on the other major surface (unnumbered) with a low adhesion backsize material. The sheets emerging from the dual coating station 3 are then overlapped once again, in the sheet spacing station 4, so as to form a pseudo-web (unnumbered) in which the trailing edge of each sheet is overlapped by the leading edge of the succeeding sheet 23. The pseudo-web is then maintained throughout the remainder of the apparatus although the initial direction of overlap, being unsatisfactory for the drying station 5 and unsuitable for the adhesive transfer station 7, is reversed when the pseudo-web leaves the sheet spacing station 4. Following passage through the drying station 5 (in which the primer and LAB coatings are dried), the pseudo-web passes through the sheet guiding station 6 where the sheets are side registered and aligned, and through the adhesive transfer station 7 where a plurality of adhesive stripes 236 are applied to the major surface of the sheets coated with primer. The sheets can then be stacked and trimmed as required to form pads of repositionable notes.

The Second Embodiment

Figure 3:
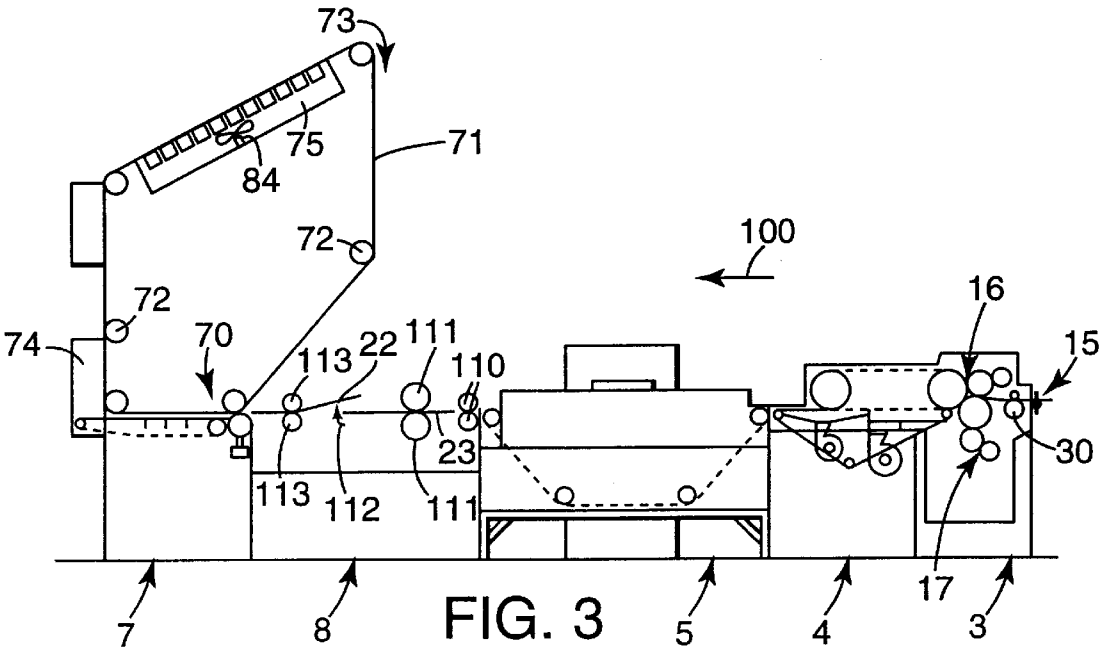
FIG. 3 is a schematic side view of a second embodiment of the invention.
Figure 4:
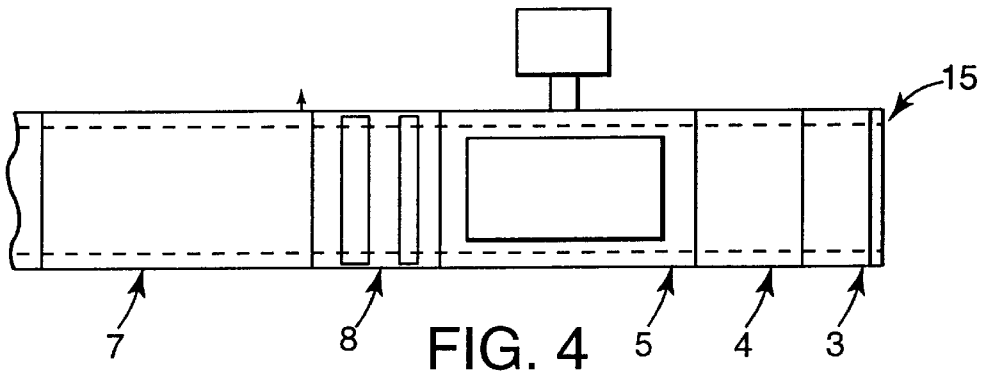
FIG. 4 is a schematic plan view of the apparatus shown in FIG. 1.

As shown in FIGS. 3 and 4, a second embodiment of the apparatus duplicates the first embodiment until the sheets reach the dual coating station 3. In the second embodiment, once the sheets travel through the dual coating station 3, the sheets are conveyed through (i) a sheet spacing station 4, (ii) a drying station 5, (iii) a sheet overlapping station 8, and finally (iv) an adhesive transfer station 7. This slightly reconfigured apparatus permits the sheets to be conveyed through both the dual coating station 3 and the drying station 5 before the sheets are overlapped.

The Third Embodiment

Figure 5:
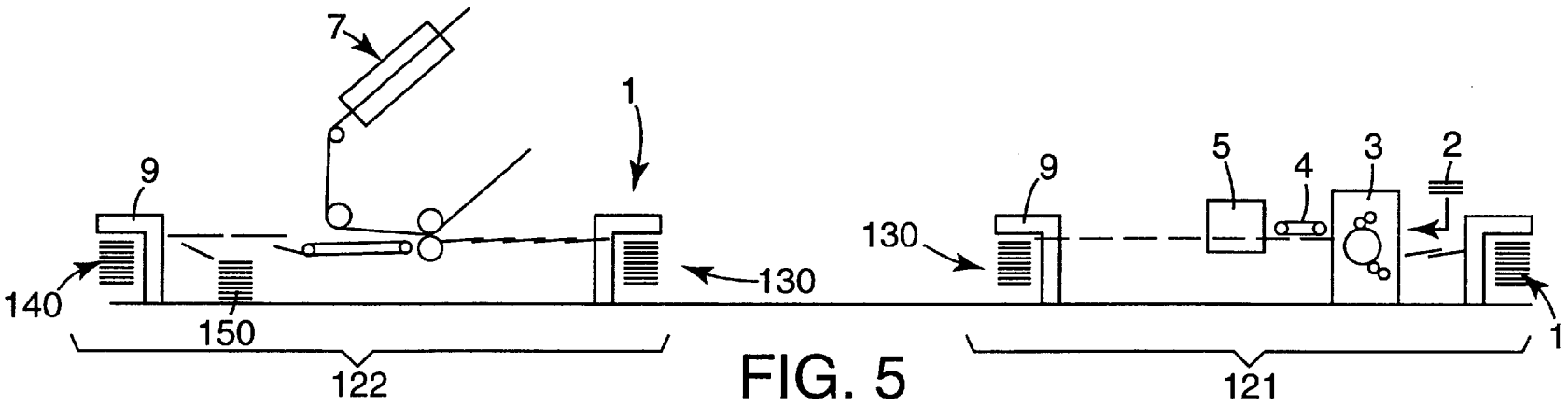
FIG. 5 is a schematic side view of a third embodiment of the invention.
Figure 20:
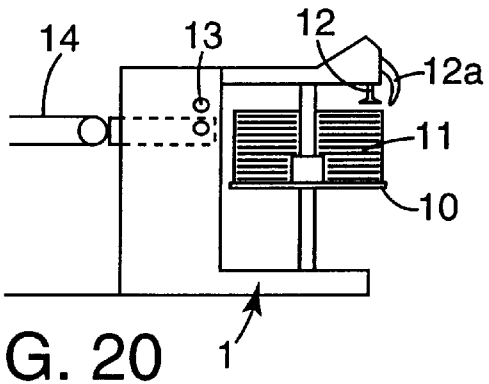
FIG. 20 is an enlarged side view of the sheet feeder station shown in FIG. 5.

As shown diagrammatically in FIG. 5, a third embodiment of the apparatus duplicates the first or second embodiments, but splits the process and the apparatus into two independent and distinct portions. The first portion 121 includes the sheet feeding station 1, sheeting inserting station 2, dual coating station 3, sheet spacing station 4, and sheet drying station 5 described in connection with the first and second embodiments. The first portion 121 terminates with a sheet stacking station 9 where stacks 130 of dual coated and dried sheets are collected. The second portion 122 commences with a duplicate of the sheet feeding station 1 into which a stack 130 of the dual coated and dried sheets has been inserted. The second portion then includes the sheet overlapping station 8 and adhesive transfer station 7 described in connection with the first and second embodiments. Finally, the second portion, like the first portion, terminates with a sheet stacking station 9 for stacking the adhesive coated sheets.

This split system permits each part of the process to be conducted independently of the other. Hence, sheets can be coated with primer and LAB at one time and/or place, and the adhesive coated onto the sheets at a different time and/or place.

Alternatively, the second portion of the process can utilize dual coated sheets which have been produced by a completely different process, such as sheets produced by the conventional roll-to-roll process which coats primer and LAB onto a continuous roll of a substrate which is subsequently cut into sheets.

The Sheet Feeding Station

While a variety of suitable sheet feeding stations are commercially available, a suitable sheet feeding station 1 is shown in FIG. 1. The sheet feeding station 1 shown in FIG. 1 is a rear edge feeder comprising a vertically movable table 10 on which a stack of sheets 11 is located. A suction head 12 is positioned above the rear edge (unnumbered) of the stack 11 for lifting the top sheet (unnumbered) from the stack 11 by its rear edge and moving the sheet forward. Forward movement of the lifted sheet is assisted by a jet of air from jet nozzle 12*a*. The lifted sheet is then taken up by paired feed rollers 13 and conveyed out of the sheet feeding station 1 and onto a first conveyor 14. The suction head 12 returns to its original position and picks up the next sheet and repeats the process while the first sheet is still present between the paired feed rollers 13. In that way, the trailing edge (not shown) of each preceding sheet 22 overlaps the leading end (not shown) of the succeeding sheet 23 as the sheets pass between the paired feed rollers 13 and are fed onto the first conveyor 14. The length of the overlap depends on the length of the sheets and the relationship between the operation of the suction head 12 and the take-up speed of the paired feed rollers 13. In order to avoid the need for an unnecessarily long gap between the sheet feeding station 1 and the dual coating station 3, the length of the overlapping portions of each sheet is preferably quite large. For example, an overlap of about 70% of the length of each sheet may be satisfactorily used.

As the height of the stack 11 decreases, the table 10 moves upwards to maintain the top (unnumbered) of the stack 11 in a predetermined vertical location relative to the suction head 12. The sheets in each stack 11 are preferably all of the same size and weight.

Sheet feeders of the type just described are available from a variety of sources including MABEG Maschinenbau GmbH of Offenbach, Germany, under the trade designation "41988".

The First Conveyor and Stop Gate

Sheets exiting the sheet feeding station 1 are deposited on the first conveyor 14 and transported past the sheet inserting station 2 to a stop gate 15 at the entry (unnumbered) to the dual coating station 3. When the sheet inserting station 2 is not operating, the overlapped sheets deposited onto the first conveyor 14 by the sheet feeding station 1 form a continuous succession of overlapped sheets on the first conveyor 14. As each sheet arrives at the stop gate 15, its forward progress is temporarily halted while the coating drum 33 rotates to the correct position for transporting and coating the sheet. The stop gate 15 then opens to allow a single accumulated sheet to enter the dual coating station 3. The stop gate 15 then closes in advance of the arrival of a succeeding sheet 23 so as to temporarily halt the forward progress of that sheet until the coating drum 33 has once again rotated to the correct position.

The Sheet Inserting Station

The sheet inserting station 2 is used to insert one or more sheets from a second stack of sheets (not shown) into the succession of sheets entering the dual coating station 3. To avoid disrupting the pseudo-web of sheets which is formed in the sheet spacing station 4, it is important that the inserted sheet(s) be accurately placed in the succession of sheets supplied to the dual coating station 3.

The sheet inserting station 2 includes a rear edge insert sheet feeder 2*b* which is generally similar to the rear edge sheet feeder described in connection with the sheet feeding station 1. The sheet inserting station 2 is located to the side of the sheet path and positioned between the sheet feeding station 1 and the stop gate 15. The sheet inserting station 2 is provided with an insert conveyor 2*a* which feeds insert sheets 20 directly into the sheet path upstream from the stop gate 15. The insert sheets 20 can be constructed from any suitable type of material, but will normally differ in some manner from the sheets dispensed by the sheet feeding station 1. Between each periodic insertion of an insert sheet 20, the sheet inserting station 2 holds several overlapped sheets on the insert conveyor 2*a* which are ready to be quickly inserted into the sheet path. When an insert sheet 20 is to be inserted into the succession of sheets being transported along the sheet path, operation of the sheet feeding station 1 is inhibited for one cycle so that a sheet will be missing from the succession of sheets fed by the sheet feeding station 1 onto the first conveyor 14 at a predetermined location. The insert conveyor 2*a* is actuated at the appropriate time to insert an input sheet into the sheet path to replace the missing sheet 21. If required, more than one insert sheet 20 can be inserted in succession, in which case it would be necessary to inhibit operation of the sheet feeding station 1 for a corresponding number of cycles.

Figure 6:
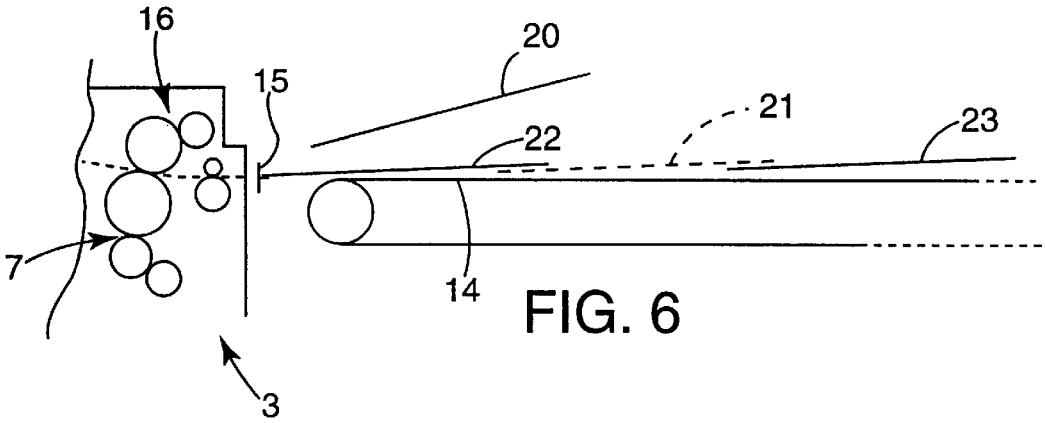
FIG. 6 is a diagrammatic illustration of the relative positions of sheets at the entry to a dual coating station forming part of the apparatus shown in FIG. 1.

FIG. 6 illustrates an insert sheet 20 in the process of being delivered to the stop gate 15. The position that the missing sheet 21 would have occupied in the succession of sheets exiting the sheet feeding station 1 is indicated by the dashed line 21. Sheet 22 represents the sheet immediately preceding the missing sheet 21. As soon as the stop gate 15 opens and allows preceding sheet 22 to enter the dual coating station 3, the insert sheet 20 is deposited immediately upstream from the stop gate 15 in the place of missing sheet 21. Because the insert sheet 20 is inserted from above the sheet path, the trailing edge (unnumbered) of the insert sheet 20 will overlap the leading edge (unnumbered) of the succeeding sheet 23, as though the insert sheet 20 had been supplied from the sheet feeding station 1.

Figure 7:
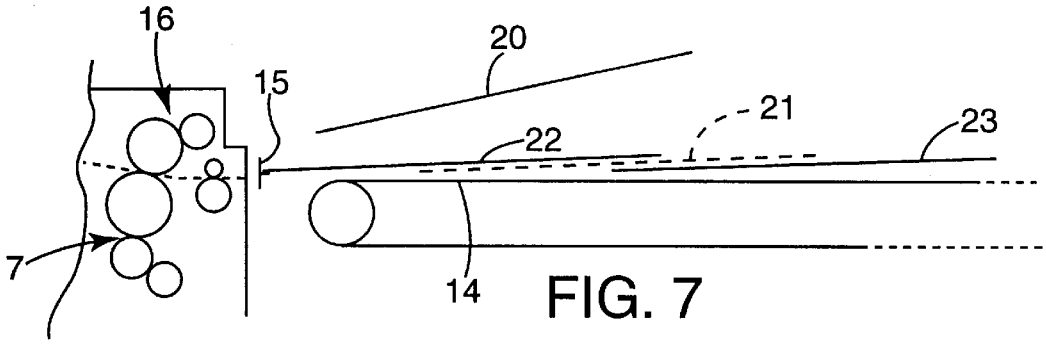
FIG. 7 illustrates an alternative arrangement of the sheets at the entry to a dual coating station forming part of the apparatus shown in FIG. 1.

For paper sheets of certain sizes, the sheet insertion procedure described above can only be carried out successfully by changing the speed at which the sheets travel from the sheet feeding station 1 to the dual coating station 3. Referring to FIG. 6, it is noted that, although forward progress of the preceding sheet 22 has been halted at the stop gate 15, the succeeding sheet 23 continues to be carried forward towards the stop gate 15 by the first conveyor 14. The length of the gap (unnumbered) between the preceding sheet 22 and the succeeding sheet 23 is dependent on the length of the sheets 22 and 23. In some cases, the lengths of the sheets 22 and 23 will result in an open gap between these sheets until forward progress of the preceding sheet 22 is halted by the stop gate 15. The continued forward progress of the succeeding sheet 23 causes the leading edge of the succeeding sheet 23 to contact the trailing edge of the preceding sheet 22 while the preceding sheet 22 is still waiting at the stop gate 15. This situation is undesirable because it can cause the sheets to buckle and jam. The situation can be avoided by reducing the speed of the first conveyor 14 as necessary to ensure that the leading edge of the succeeding sheet 23 does not contact the trailing edge of the preceding sheet 22 when an open gap is created by skipping a sheet in order to accommodate an insert sheet 20. The particular sizes of paper for which such a reduction in speed will be required depends upon the normal speed of the first conveyor 14 and the length of time for which sheets are held at the stop gate 15. It may, for example, be found that A4 size sheets can be handled without any problems because the length of the gap caused by skipping a sheet is always so long that the leading edge of succeeding sheet 23 never contacts the trailing edge of the preceding sheet 22. It may also be found that A2 size sheets can be handled without any problems because, even when a sheet has been skipped, the trailing edge of the preceding sheet 22 always overlaps the leading edge of the succeeding sheet 23. This later situation is illustrated in FIG. 7, wherein the position that the missing sheet 21 would have occupied is indicated by the dashed line 21. It may, however, then be found that sheets with a length somewhere between the lengths of A4 and A2 size sheets (210 mm and 420 mm respectively) require that the speed of the first conveyor 14 be reduced. Such a speed reduction (which is necessary only when there is both a gap in the succession of sheets and the sheets will contact one another when forward progress of the preceding sheet 22 is halted at the stop gate 15) can be effected by a central electronic control unit (not shown) through a gear box 25*a* and a two-way clutch 25*b* in communication with the main drive (not shown) of the sheet feeding station 1, as indicated diagrammatically in FIG. 2.

The Dual Coating Station

Figure 8:
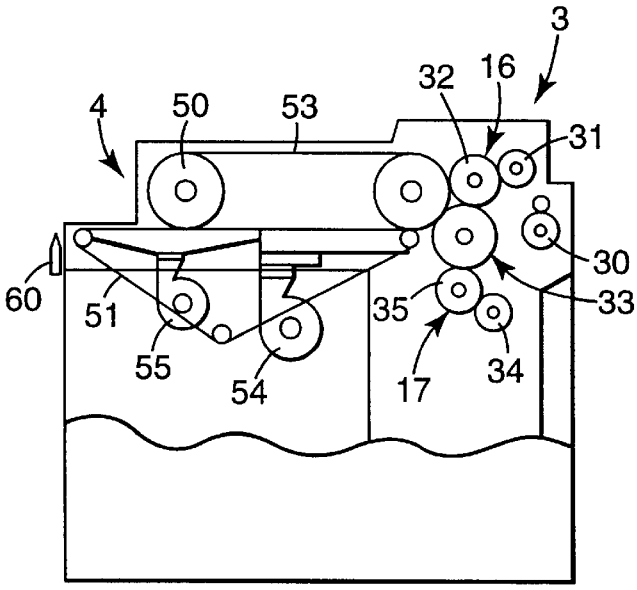
FIG. 8 is a schematic side view of a dual coating station forming part of the apparatus shown in FIG. 1.
Figure 9:
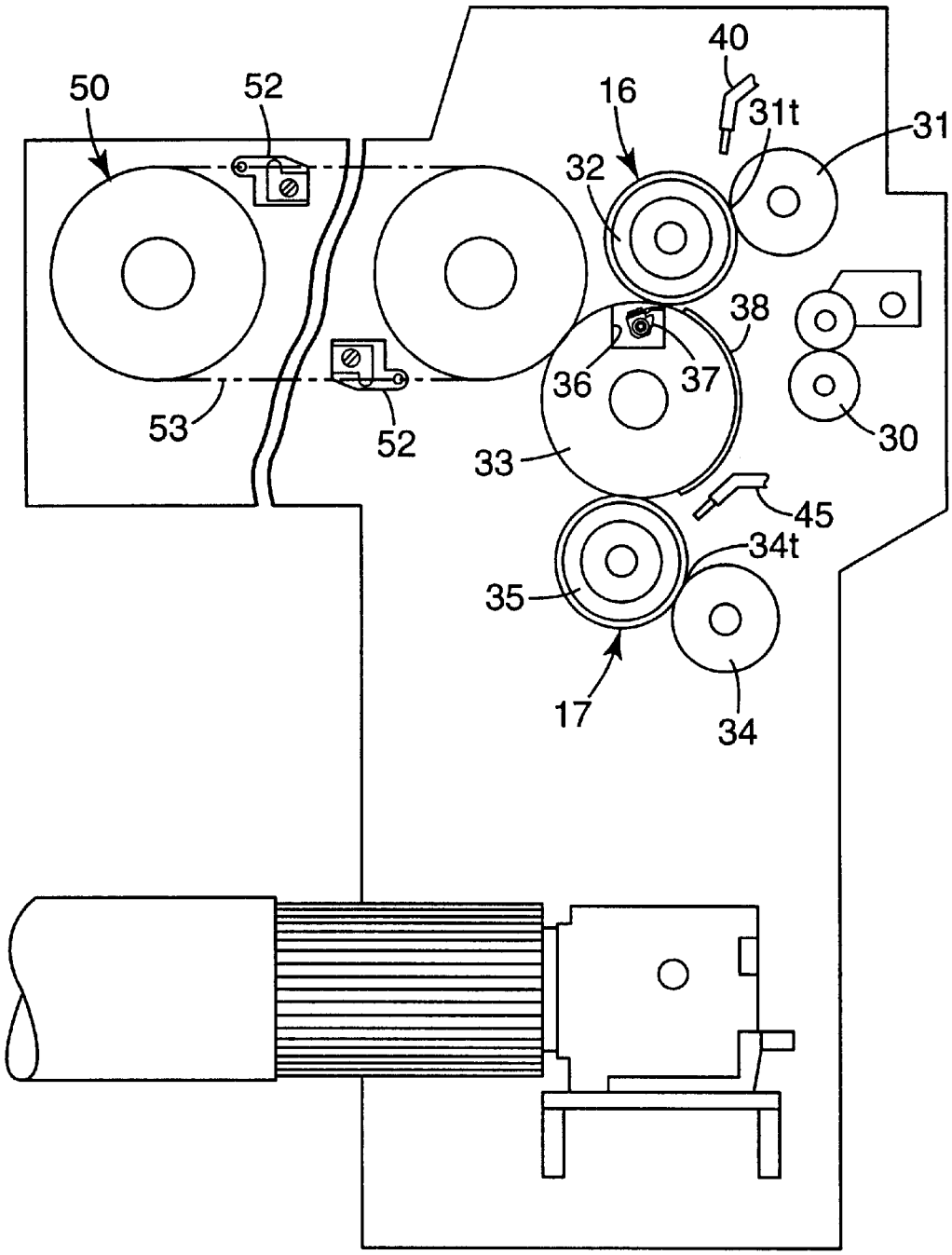
FIG. 9 is an enlarged schematic side view of a portion of the dual coating station of FIG. 8.

As shown in FIG. 1, and in greater detail in FIGS. 8 and 9, sheets fed through the stop gate 15 enter the dual coating station 3 and are picked up by a nip roll pair 30. The nip roll pair 30 feeds the sheet between the upper coating system 16 and lower coating system 17 which are located above and below the sheet path respectively. The upper coating system 16 applies a coating of primer (not shown) to the upper major surface (not shown) of each sheet and the lower coating system 17 simultaneously applies a coating of LAB (Not shown) to the lower major surface (not shown) of each sheet.

It is one of the advantages of the present apparatus, as compared to other arrangements such as in the above identified WO94/19419 reference, that the sheets are fed individually through the dual coating station 3 without any overlap. This permits substantially the entire surface area of both major surfaces on each sheet to be coated with primer and LAB.

Paper is commonly formed by accumulating paper fibers (not shown) on a wire mesh or screen (not shown) and compressing the accumulated fibers between the screen and a "felt" or cloth layer (not shown) opposite the screen layer. This produces paper having a "wire" side and a "felt" side. It has also been found advantageous to convey the sheets through the apparatus of the present invention with the "wire" side presented for coating of the release material (not shown) and the "felt" side presented for coating of the primer (not shown) and ultimately for coating of the adhesive (not shown).

Each sheet is simultaneously coated with primer and LAB. The primer and LAB are preferably selected and applied at a similar viscosity, wt % solids, coating weight, etc., so as to minimize the potential for wrinkling or curling of the sheets to which the coatings have been applied.

The coating achieved in the dual coating station 3 is discontinuous since it occurs only when the pad 38 on the coating drum 33 abuts upper coating roller 32 and a sheet has been fed through the nip roll pair 30 and onto the pad 38.

The Coating Drum

Figure 11:
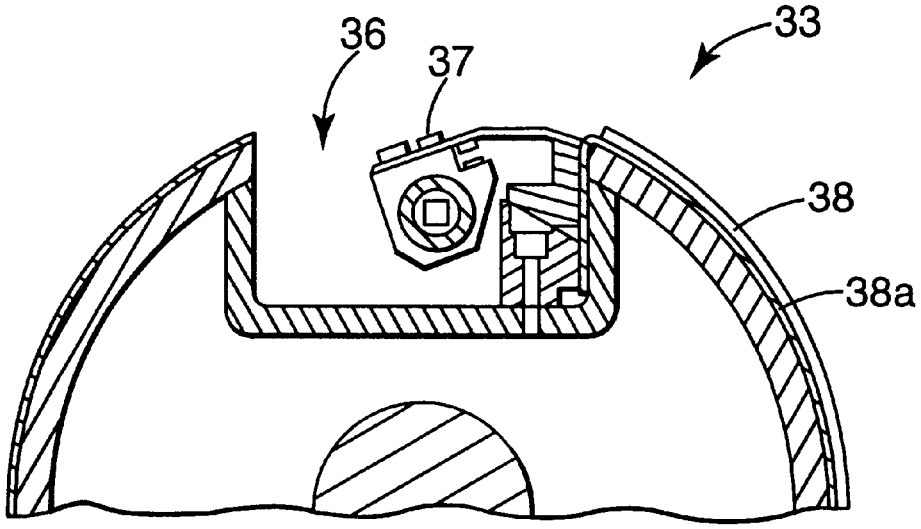
FIG. 11 is an enlarged cross-section side view of the coating drum (33) shown in FIGS. 8 and 9.

Referring to FIG. 11, the coating drum 33 includes a rectangular lateral channel 36 which contains a conventional sheet gripper 37 for grasping sheets fed from the nip roll pair 30. That portion of each sheet engaged with the sheet gripper 37 will not be available for coating with primer or LAB.

The surface (unnumbered) of the coating drum 33 is covered, around less than half its circumference, with a pad 38.

The Upper Coating System

The upper coating system 16 includes an upper metering roller 31 and an upper coating roller 32 located above the sheet path. The upper coating roller 32 cooperates with the coating drum 33 to form a coating nip (unnumbered). The coating drum 33 and the upper coating roller 32 are positioned relative to one another such that the upper coating roller 32 forms a coating nip with the coating drum 33 only when the pad 38 is adjacent the upper coating roller 32.

An upper trough 31*t* for holding a supply of primer is formed by the surfaces of the upper metering roller 31 and upper coating roller 32 and a pair of opposed end walls (not shown) which are sealably engaged within grooves (not shown) in the ends (unnumbered) of the rollers 31 and 32. As the rollers 31 and 32 are rotated, primer material in the upper trough 31*t* forms a film on the upper coating roller 32 for transference to a sheet passing underneath the upper coating roller 32 on the pad 38 of the coating drum 33.

The thickness of the primer film (not shown) on the upper coating roller 32, and hence the amount of primer coated onto a sheet, is dependent upon the viscosity of the primer and the contact pressure between the upper metering roller 31 and the upper coating roller 32. For a given primer, the thickness of the primer coated onto a sheet can be adjusted by moving the upper metering roller 31 relative to the upper coating roller 32 and by adjusting the rotational speed of the upper metering roller 31.

Figure 10:
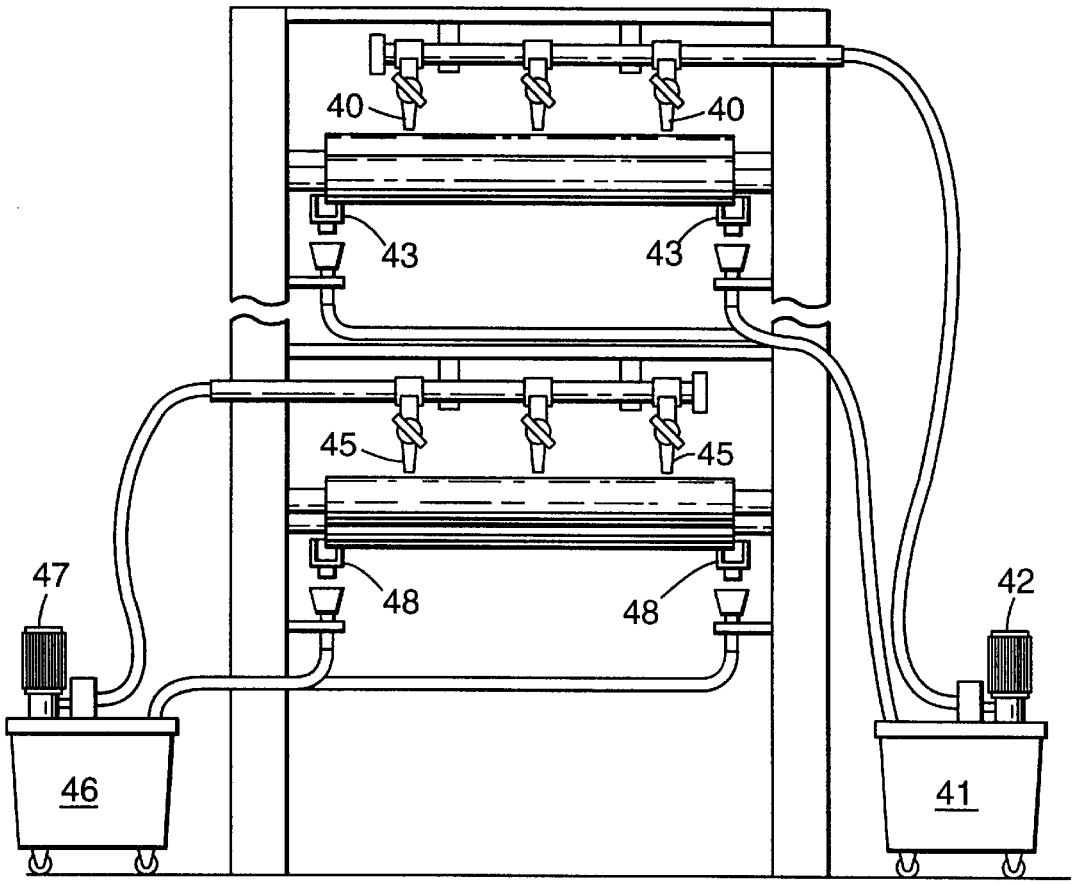
FIG. 10 is an end view of a coating material supply system for the dual coating station shown in FIGS. 8 and 9.

Referring to FIG. 10, the upper trough 31*t* is supplied with primer by laterally spaced upper nozzles 40 which receive primer from a supply tank 41 by means of a pump 42. The upper trough 31*t* also has overflow outlets 43 through which excess primer is returned to the primer supply tank 41.

The Lower Coating System

The lower coating system 17 is essentially a mirror image of the upper coating system 16 positioned below the sheet path. The lower coating system 17 includes a lower metering roller 34 and an lower coating roller 35 located above the sheet path. The lower coating roller 35 cooperates with the coating drum 33 to form a coating nip (unnumbered). The coating drum 33 and the lower coating roller 35 are positioned relative to one another such that the lower coating roller 35 forms a coating nip with the coating drum 33 only when the pad 38 is adjacent the lower coating roller 35.

A lower trough 34*t* for holding a supply of LAB is formed by the surfaces of the lower metering roller 34 and lower coating roller 35 and a pair of opposed end walls (not shown) which are sealably engaged within grooves (not shown) in the ends (unnumbered) of the rollers 34 and 35. As the rollers 34 and 35 are rotated, LAB material in the lower trough 34*t* forms a film on the lower coating roller 35 for transference to a sheet passing over the lower coating roller 35 on the pad 38 of the coating drum 33.

The thickness of the LAB film (not shown) on the lower coating roller 35, and hence the amount of LAB coated onto a sheet, is dependent upon the viscosity of the LAB and the contact pressure between the lower metering roller 34 and the lower coating roller 35. For a given LAB, the thickness of the LAB coated onto a sheet can be adjusted by moving the lower metering roller 34 relative to the lower coating roller 35 and by adjusting the rotational speed of the metering roller 34.

Referring to FIG. 10, the lower trough 34*t* is supplied with LAB by laterally spaced lower nozzles 45 which receive LAB from a supply tank 46 by means of a pump 47. The lower trough 34*t* also has overflow outlets 48 through which excess LAB is returned to the LAB supply tank 46.

The sheets may optionally be pre-printed with indicia. In order for the indicia to be presented on the front surface of the padded notes (not shown) the indicia must be printed on the major surface of the sheets which is coated with the LAB. Hence, when pre-printed sheets are coated in the dual coating station 3, the printed indicia will be covered with the LAB applied to the sheet by the lower coating system 17. In this way, the LAB serves to protect the printed matter, especially from being removed by the adhesive coated onto the immediately preceding note in the stack. Such protection offered by the LAB coating enables the use of stronger adhesives on pads of pre-printed notes. Of course, printed indicia may also be applied to the sheets after the sheets exit the dual coating station 3 using conventional printing techniques.

Sheet Strippers

Sheet strippers (not shown) are located on the downstream side of both the upper 32 and lower 35 coating rollers as well as the coating drum 33 to ensure that sheets do not wrap around the rollers 32, 35 or the drum 33, but exit the dual coating station 3 and proceed towards the sheet spacing station 4.

Figure 12:
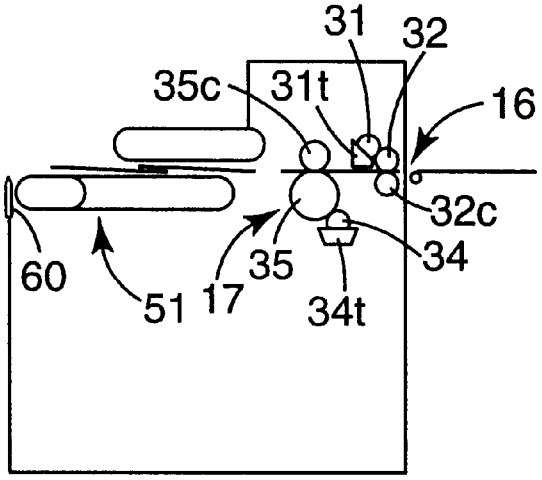
FIG. 12 is a schematic side view of a second embodiment of a dual coating station.

Alternatively, as shown in FIG. 12, the dual coating station 3 could apply the primer and LAB coatings sequentially rather than simultaneously. For example, the coating drum 33 is removed and the upper coating system 16 located upstream from the lower coating system 17.

Each of the upper coating roller 32 and the lower coating roller 35 are provided with a counter-pressure roller 32*c* and 35*c*, respectively. However, such an alternative method does not provide the benefits associated with the simultaneous coating procedure described herein. It is noted that the alternative embodiment shown in FIG. 12 also depicts supply troughs 31*t* and 34*t*, for supplying primer and LAB materials to the upper 31 and lower 34 metering rollers, respectively.

Pad and Support Sheet

The pad 38 on the coating drum 33 can be constructed from any suitable type of material. Preferred materials are the various elastomeric materials such as the natural and synthetic rubbers. The pad 38 is secured by an adhesive (not shown) to a support sheet 38*a* which is wrapped around and releasably secured to the coating drum 33. Suitable materials for use as the support sheet 38*a* include the various flexible plastics such as Mylar™. The pad 38 may be secured to the support sheet 38*a* by a neoprene glue such as that available under the trade designation 1236™ from Minnesota Mining and Manufacturing Company of St. Paul, Minn., U.S.A. The support sheet 38*a* preferably extends around the full circumference of the coating drum 33 with the ends (unnumbered) of the support sheet 38*a* extending down into the channel 36 formed in the coating drum 33 The support sheet 38*a* may be releasably secured to the coating drum 33 by any convenient means such as bolts or machine screws (not shown). In that way, the pad 38, which is a wearable item, is securely attached to the coating drum 33, but can be easily removed from the coating drum 33 and replaced when necessary.

Should the pad 38 be adhered to the support sheet 38*a* while the support sheet 38*a* is laid-out flat, it is preferred that a flexible adhesive be used to secure the pad 38 to the support sheet 38*a*. Obviously, the flexibility of the adhesive is less important when the pad 38 is secured to the support sheet 38*a* only after the support sheet 38*a* has been conformed to the shape of the coating drum 33. Any suitable adhesive can be used to secure the pad 38 to the support sheet 38*a* provided the adhesive is sufficiently aggressive to prevent the corners of the pad 38 from lifting away from the support sheet 38*a* throughout the lifespan of the pad 38.

The pad 38 may be constructed from Cyrell™, a polyurethane material available from E.I. DuPont de Nemours of Wilmington, Del., U.S.A.

Primer

The primer may, by way of example, be an aqueous solution of an organic binding agent and a cleaved mineral pigment. More specifically, the primer material may be obtained by mixing approximately 3 to 7 wt % of the binding agent MOWIOL™ available from Hoechst AG of Frankfurt/Main, Germany, and approximately 3 to 8 wt % of the pigment AEROSIL™ available from Degussa AG, Frankfurt/Main, Germany, in water.

A typical coating weight for the primer on the sheets is from about 0.5 gsm to about 12.0 gsm. The coating weights of the primer and the LAB are preferably matched so that both major surfaces of each sheet dry at approximately the same rate and thereby reduce the wrinkling and curling commonly associated with the drying of wet sheets.

Low Adhesion Backsize (LAB)

The LAB may be selected from any of a variety of suitable materials including, but not limited to, acrylate copolymers, silicones, urethanes, and fluoro polymers. For example, the LAB may be selected from the aqueous LAB solutions described in EP-A-0618509. Other LAB materials that may be employed include those disclosed in U.S. Pat. Nos. 5,202,190 and 5,032,460.

A typical coating weight for the LAB on the sheets is from about 0.5 gsm to about 12.0 gsm. Again, the coating weights of the primer and the LAB are preferably matched so that both major surfaces of each sheet dry at approximately the same rate and thereby reduce the wrinkling and curling commonly associated with the drying of wet sheets.

The Sheet Spacing Station

As shown in FIG. 1, and in greater detail in FIGS. 8 and 9, sheets exiting the dual coating station 3 enter a sheet spacing station 4 in which a clasping unit 50 is positioned to grab the dual coated sheets as they emerge from the coating nip, and deposit them on a second conveyor 51 shown in FIG. 8. The clasping unit 50 is a conventional unit which includes clasps 52 carried on an endless chain 53. Movement of the chain 53 is synchronized with rotation of the coating drum 33 so that a clasp 52 is positioned to receive each dual coated sheet as the sheet leaves the coating nip.

With reference to FIG. 8, a blower 54 is positioned below the sheet path, proximate the exit side of the coating nip, for providing a cushion of air to support the sheets as they are carried by the clasps 52 towards the second conveyor 51. The blower 54 incorporates a heater (not shown) which serves to partially dry the LAB coating on the underside of the sheet before the sheet is deposited upon the second conveyor 51. This reduces the tendency of the dual coated sheets to stick to the second conveyor 51.

The second conveyor 51 is run at a slower speed than the chain 53 of the clasping unit 50. This causes a leading edge portion of each sheet which is deposited on the second conveyor 51 to overlap a trailing edge portion of the preceding sheet 22 and form a pseudo-web of overlapped sheets. Typically, but not essentially, the extent of the overlap is from about 1 to 2 cm.

Alternatively, the second conveyor 51 can be run at essentially the same speed as the chain 53 of the clasping unit 50. This maintains a gap between the sheets deposited on the second conveyor 51. Such an arrangement of the sheets allows the sheets to be dried individually within the drying station 5 and thereby avoid those issues resulting from the drying of partially overlapped sheets.

The second conveyor 51 is preferably a vacuum conveyor which is connected to a source of low pressure 55. The suction created by the low pressure source 55 holds the sheets in position on the second conveyor 51 for maintaining the necessary overlapped relationship between the sheets.

A single unit which combines a dual coating station 3 and a sheet spacing station 4 is commercially available from Billhöfer Maschinenfabrik GmbH of Nürnberg, Germany under the designation Gulla Speed GS GS 8000™.

Overlap Reversing System

Figure 13:
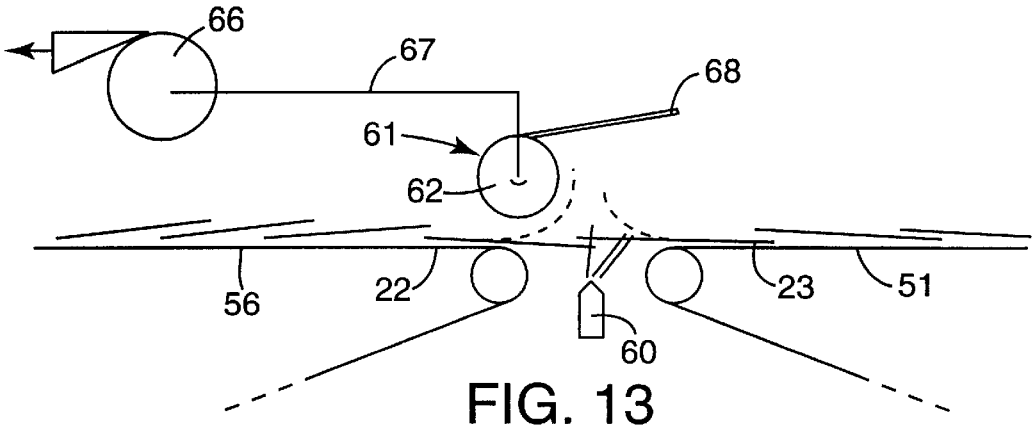
FIG. 13 is an enlarged diagrammatic side view illustrating a portion of the apparatus shown in FIG. 1.
Figure 14:
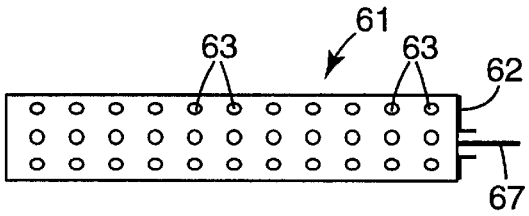
FIG. 14 is an enlarged end view of the vacuum cylinder (61) shown in FIG. 13.

As shown in FIG. 13, the sheets on the second conveyor 51 are transferred to a third conveyor 56 for transportation through a drying station 5. A system (unnumbered) for reversing the overlapped position of the sheets when they have been overlapped by the sheet spacing station 4 is provided between the second 51 and third 56 conveyors. The system includes (i) an air knife 60 positioned below the sheet path and between the second 51 and third 56 conveyors for lifting the overlapped edge portions of the sheets as they pass over the air knife 60, and (ii) a stationary vacuum cylinder 61 positioned above the sheet path and slightly downstream from the air knife 60 for attracting and temporarily delaying return of the lifted trailing edge portion of the sheets. The system thereby causes the leading edge portion of each sheet to return to the paper path before the trailing edge portion of the preceding sheet 22 returns so as to reverse the overlapped relationship between each set of overlapped sheets.

The vacuum cylinder 61 has closed ends 62 and a plurality of apertures 63 through that portion of the vacuum cylinder surface (unnumbered) directed towards the air knife 60. The remainder of the vacuum cylinder 61 is closed. The apertures 63 are connected to the hollow interior (not shown) of the vacuum cylinder 61, and the hollow interior connected by a line 67 to a vacuum pump 66.

The vacuum cylinder 61 can conveniently have a diameter of about 15 cm with three rows of apertures 63 spaced 30 mm apart. The apertures 63 can conveniently have a diameter of 6 mm with the individual apertures 63 in each row spaced 30 mm apart.

Since the suction exerted by the vacuum cylinder 61 does not influence the sheets while they are within the sheet plane, the vacuum can be applied constantly. The vacuum should be applied at a level sufficient to ensure that it attracts and retains the trailing edge of the sheets lifted by the air knife 60 without interfering with continued forward movement of the sheet on the third conveyor 56.

Optionally, a deflection plate 68 can be positioned above the vacuum cylinder 61 and the air knife 60, such as shown in FIG. 13, to direct the air jet emanating from the air knife 60 towards the vacuum cylinder 61.

Other systems can also be used to reverse the overlap of a succession of overlapped sheets such as an air knife 60 alone or a mechanical arrangement similar to that described in GB-A-2 166 717. However, such systems would not provide the efficiency and reliability associated with the system described herein.

Drying Station

Returning to FIG. 1, the pseudo-web of overlapped sheets is transported by the third conveyor 56 from the sheet spacing station 4 and through a drying station 5 where moisture is removed from the primer and LAB coatings on the sheets. The overlapped sheets are moved continuously through the drying station 5 by the third conveyor 56 and are dried at a rate which attenuates the tendency of the sheets to curl without unduly slowing the line speed or requiring an overly large drying station 5.

The drying station 5 preferably uses a radio-frequency dryer to dry the primer and LAB coatings. A suitable dryer is a Model No. SP 890 GF "C"-AG manufactured by Proctor Strayfield Ltd. of Berkshire, England which has been adapted to fit this specific system. The use of a radio-frequency dryer is preferred but not essential. The overlapped sheets could, instead, be dried using infra-red or forced air heating systems. Alternatively, the third conveyor 56 could be heated. However, a radio-frequency dryer is preferred for a number of reasons, including its simplicity, lower energy consumption, reduced thermal build-up, etc.

The drying station 5 is provided with a control unit (not shown) for automatically adjusting the power of the dryer in accordance with the line speed of the system. A suitable control unit is available from Siemens under the designation PLC 55 95U. The control unit can be interconnected with the central electronic control unit (not shown) for the entire system, for purposes of sending and receiving the information necessary to properly monitor and control operation of the system.

Although it is preferable to reverse the direction of overlap before the sheets enter the drying station 5 in order to reduce the likelihood that the sheets will be lifted from the third conveyor 56, it is possible to reverse the direction of the overlap after the sheets have been dried by positioning the sheet spacing station 4 downstream from the drying station 5 as shown in FIG. 3.

Sheet Guiding Station

As shown in FIG. 1, the dried coated sheets are transferred from the third conveyor 56 to a sheet guiding station 6 in which the sheets are side registered and aligned with each other in preparation for advancement through the adhesive transfer station 7.

Sheet Overlapping Station

As shown in FIG. 3, when the sheets are fed individually through the drying station 5, a sheet overlapping station 8 is positioned between the drying station 5 and the adhesive transfer station 7 for overlapping the sheets before they enter the adhesive transfer station 7.

The sheet overlapping station 8 comprises a pair of input rollers 110 which take up sheets exiting the drying station 5 and pass the sheets between a pair of drive rollers 111. The drive rollers 111 transport the sheets to a lever 112. The lever 112 pivots between a first position, as shown in FIG. 3, where the lever 112 projects into the sheets path and stops the forward progress of any sheets which contact the lever 112, and a second position where the lever 112 is positioned below the sheet path and any accumulated sheets are allowed to proceed forward towards the adhesive transfer station 7.

The drive rollers 111 are pivotable between an open position and a closed position in response to the position of the lever 112. The drive rollers 111 are opened when the lever 112 is pivoted into the first position so that a sheet emerging from the input rollers 110 will pass freely between the drive rollers 111 and be temporarily halted at the lever 112. When the lever 112 is pivoted into the second position below the sheet path, the drive rollers 111 are closed and form a nip which propels the sheet resting on the drive rollers 111 towards output rollers 113. Once the sheet has been taken up by the output rollers 113, the lever 112 is returned to the first position and the drive rollers 111 opened to allow a succeeding sheet 23 from the input rollers 110 to pass through to the lever 112 until the succeeding sheet 23 strikes the lever 112.

As shown in FIG. 3, the lever 112 is returned to the first position while a portion of the preceding sheet 22 is still positioned over the lever 112 so that a trailing portion of the preceding sheet 22 is lifted up from the sheet path by the lever 112. The lever 112 is then pivoted to the second position and the drive rollers 111 closed while a trailing edge portion of the preceding sheet 22 is still above the lever 112 so that the trailing edge portion of the preceding sheet 22 will overlap a leading edge portion of the succeeding sheet 23. Typically, an overlap of between about 1 to 2 cm is sufficient to ensure that a complete pseudo-web of overlapped sheets will be transported to the adhesive transfer station 7.

It will be appreciated that the particular sheet overlapping station 8 described herein to produce the pseudo-web of sheets is not an essential feature of the overall system, and that any other mechanism capable of producing the same overlapping arrangement of sheets could be employed.

Adhesive Transfer Station

The registered overlapped sheets pass through a transfer location 70 where they contact an endless transfer belt 71 to which an adhesive coating (not shown) has previously been applied in the form of a plurality of stripes 236 extending longitudinally along the transfer belt 71.

Transfer Belt

The transfer belt 71 is trained around a series of tension rollers 72, at least one of which is driven so that the transfer belt 71 advances in the direction of the arrow 73 and in the machine direction 100 through the transfer location 70. The transfer belt 71 is advanced at the same speed as the overlapped sheets and passes (i) a coating system 74, (ii) an adhesive dryer 75, and (iii) the transfer location 70.

The transfer belt 71 may be constructed from a variety of materials including various silicone rubber coated metals and plastics. The transfer belt 71 is preferably constructed from a radio frequency transparent material so that a radio frequency adhesive dryer 75 may be used. As utilized herein, the term "radio frequency transparent" means that the material does not appreciably interact with radio frequency radiation such that the radiation passes through the material without generating appreciable heat or volatilizing the material. A suitable radio frequency transparent transfer belt 71 comprises an approximately 0.1 mm thick fiberglass fabric base layer 22*a* coated on both major surfaces with an approximately 0.15 mm thick silicone rubber skin.

Figure 27:
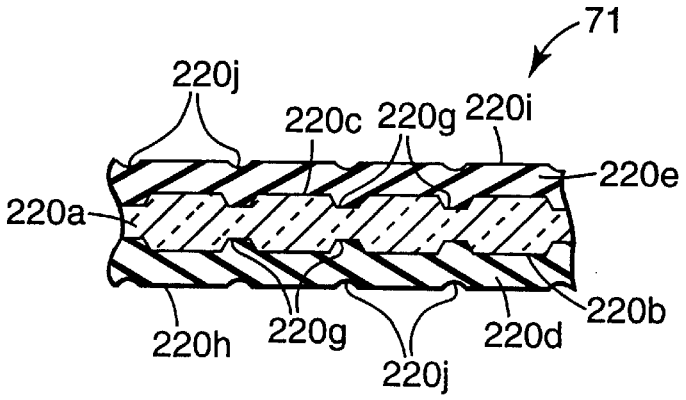
FIG. 27 is a cross-sectional side view of one embodiment of the transfer belt shown in FIGS. 21 and 25.

One embodiment of the transfer belt 71 is shown in cross-section in FIG. 27. In this embodiment, the transfer belt 71 includes a base layer 220*a* comprising a 0.004 inch thick fiberglass fabric belt which is commercially available from J. P. Steven, of North Carolina. The base layer 220*a* is coated on both the front 220*b* and back 220*c* major surfaces with a 0.003 inch thick release layer 220*d* and 220*e* respectively. The outermost surfaces 220*h* and 220*i* of the release layers 220*d* and 220*e* form the surface which receives adhesive from the gravure roller 77 and transfers the adhesive to the overlapped sheets at the transfer location 70. The combination of base layer 220*a* and release layers 220*d* and 220*e* results in a transfer belt 71 having a total thickness of approximately 0.010 inches. A suitable material for use in forming the release layers 220*d* and 222*e* is a dispersion of a silicone rubber solution available from the Silicone Products Division of General Electric Co. of Waterford, N.Y. under the designation G.E. SE-100. The solution contains 6 wt % solids with a 78% benzoyl peroxide solution in water as a catalyst.

The release layers 220*d* and 220*e* can be formed by knife coating the desired material onto the base layer 220*a* and oven dried at 360° F. at a rate of 60 yards/hour. The release layers 220*d* and 220*e* facilitate the release of adhesive from the transfer belt 71 onto the overlapped sheets at the transfer location 70.

The outermost surfaces 220*h* and 220*i* of the release layers 220*d* and 220*e* may be smooth or textured, but are preferably textured or convoluted for purposes of further facilitating the release of adhesive from the transfer belt 71 onto the overlapped sheets. Most preferably, the outer surfaces 220*h* and 220*i* are textured with a pattern of indentations that impose a complementary pattern in the adhesive stripes 236 transferred from the transfer belt 71 to the overlapped sheets of paper at the transfer location 70.

Figure 28:
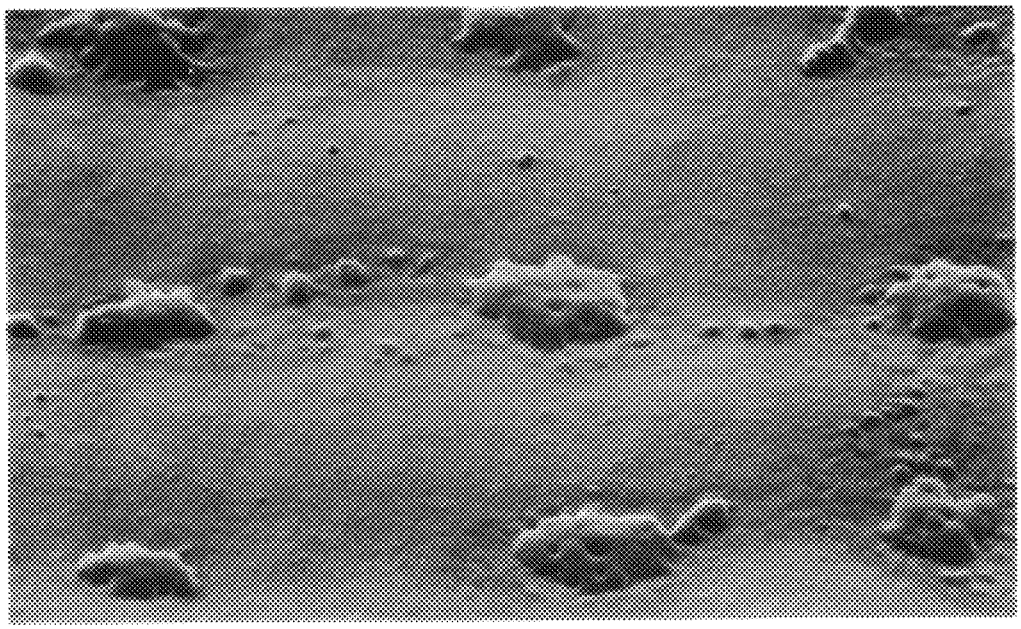
FIG. 28 is a photomicrograph illustrating a repositionable adhesive which has been manually applied to the transfer belt of the apparatus as shown in FIGS. 21 and 25.

A preferred indentation pattern is shown in FIG. 28. The pattern generally comprises an array of indentations 220*j* which are formed from corresponding indentations 220*g* in base layer 220*a*. The indentations 220*g* in the base layer 220*a* may be formed during the process of weaving the fiberglass layer. Alternatively, the pattern of indentations 220*g* in the base layer 220*a* may be embossed or otherwise imposed on the outermost surfaces 220*h* and 220*i* of the release layers 220*d* and 220*e*.

The indentations 220*j* on the outermost surface of the release layers 220*d* and 220*e* have (i) a preferred width of from 40 to 200 microns, most preferably a width of approximately 100 microns, and (ii) a preferred depth of from 50 to 100 microns. The indentations 220*j* are preferably spaced approximately 10 to 30 microns apart in a rectangular array. Such a pattern on the outermost surfaces 220*h* and 220*i* of the release layers 220*d* and 220*e* are particularly useful when applying a pressure-sensitive microsphere adhesive. We believe that microsphere adhesives tend to "wet out" on the outermost surfaces 220*h* and 220*i* of the release layers 220*d* and 220*e*, while the microspheres in the adhesive composition tend to gravitate towards and be retained within each of the indentations 220*j*. Consequently, adhesive transferred to the overlapped sheets tend to maintain the surface pattern shown in FIG. 28, with a resulting uniform distribution of microspheres and superior adhesion.

It is preferred that the front 220*d* and back 220*e* release layers be of the same thickness with the same size, shape and pattern of indentations 220*j* so that adhesive may be coated onto either the front 220*h* or back 220*i* outermost surface of the transfer belt 71 as necessary to prolong the useful life of the transfer belt 71 without changing the characteristics of the adhesive strips 236 transferred to the overlapped sheets in the transfer location 70. Of course, a transfer belt 71 having a release layer 220*d* or 220*e* on only one major surface 220*b* or 220*c* can be used if desired.

When a gravure roller 77 is used to apply the adhesive stripes 236 to the transfer belt 71 as described above, the pattern in the adhesive stripes 236 is further influenced by the form of the gravure pattern. Hence both the pattern on the gravure roller 77 and the transfer belt 71 should be chosen with a view to enhancing the even distribution of microspheres in the adhesive stripe 236 applied to the sheets.

Alternatively, other arrangements may be employed, including, for example, a cylindrical drum (not shown) in contact with both the gravure roller 77 and the sheet path. Hence, although the intermediate carrier will hereinafter be referred as a transfer belt 71, it is to be understood that the present invention is not limited thereto.

Adhesive Transfer Coating System

Figure 15:
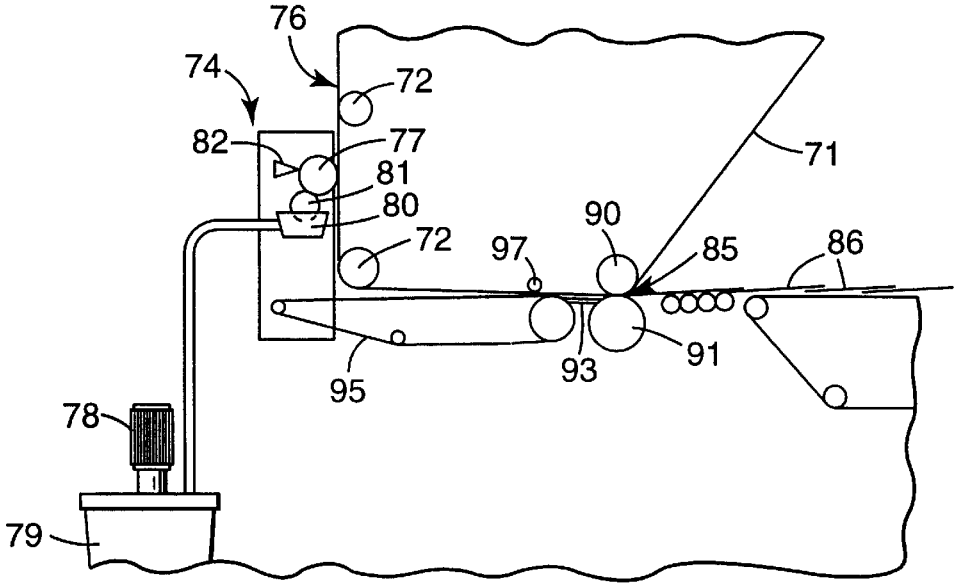
FIG. 15 is an enlarged diagrammatic side view illustrating the adhesive transfer station shown in FIG. 1.
Figure 25:
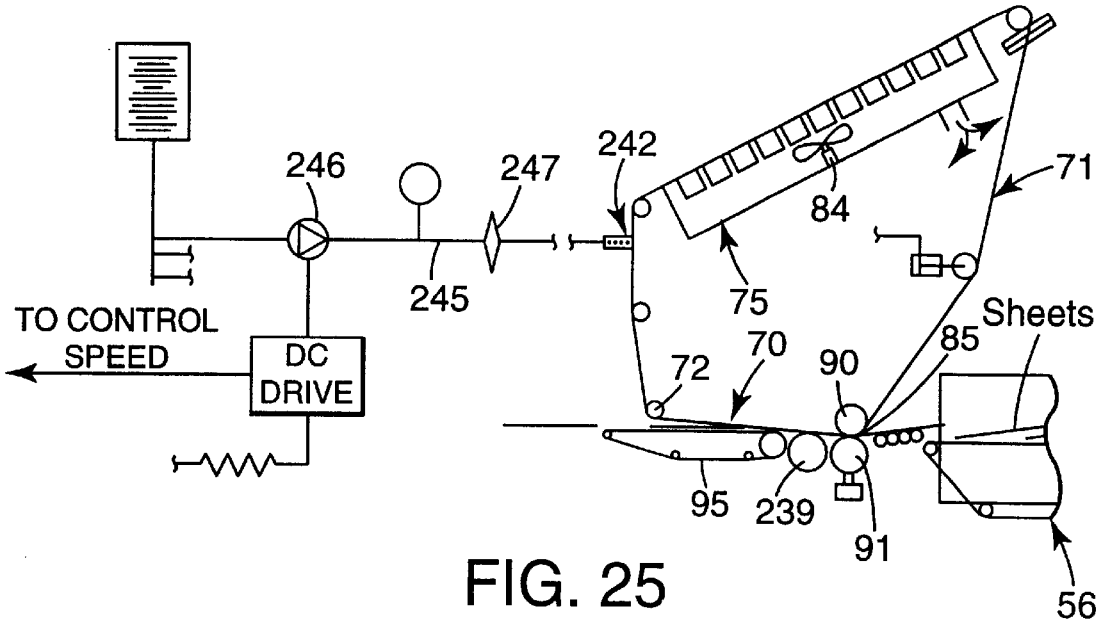
FIG. 25 is a schematic and diagrammatic side view of a third embodiment of an adhesive transfer system.
Figure 26:
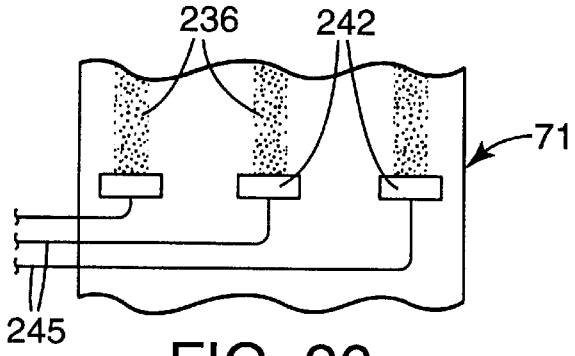
FIG. 26 is an enlarged partial view in the direction of the arrow 8 in FIG. 25.

The adhesive coating system 74 applies at least one longitudinal stripe 236 of a pressure sensitive adhesive to the transfer surface 76 of the transfer belt 71. The adhesive coating system 74 may be any of a number of suitable coating devices, including, by way of example, a reverse rotating gravure roller 77 as shown in FIG. 15, or a coating die 242 as shown in FIGS. 25 and 26.

Gravure Roller

The gravure roller 77 contacts the transfer belt 71 across substantially the entire width (not shown) of the belt 71. The gravure roller 77 includes at least one gravure ring 77*r*, formed of a plurality of cells or cavities 230, extending around the full circumference of the gravure roller 77 at the desired location of an adhesive stripe 236 on the transfer belt 71.

If the gravure roller 77 rotates in the same direction as the transfer belt 71, the adhesive transfer process is referenced as a direct gravure coating process. If the gravure roller 77 rotates in an opposite rotational direction as the transfer belt 71, the adhesive transfer process is referenced as a reverse gravure coating process. Although either arrangement may be employed in the present invention, unless otherwise specified, the process shown and described herein is based upon a reverse gravure process. Typically, the gravure roller 77 is rotated in the same direction and at approximately the same speed as the transfer belt 71, so that the adhesive coating system 74 functions as a reverse gravure process.

Figure 22:
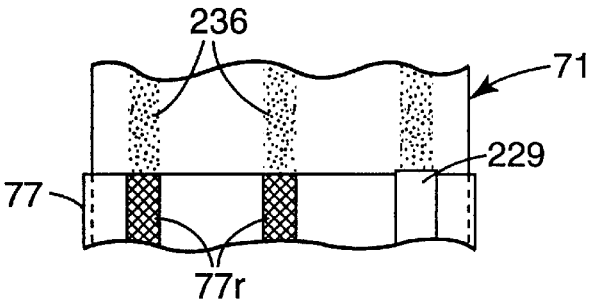
FIG. 22 is an enlarged partial view in the direction of the arrow 4 in FIG. 21.
Figure 24:
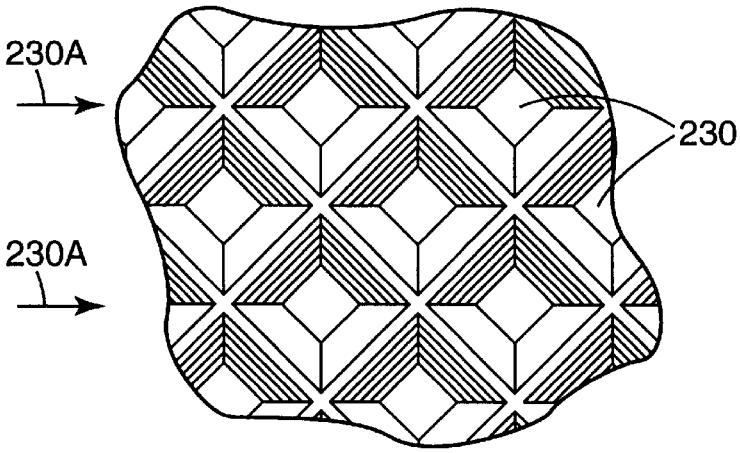
FIG. 24 is a greatly magnified view of the gravure rings **(77*r*) shown in FIG. 22**.

FIG. 22 depicts three gravure rings 77*r*, applying three longitudinal adhesive stripes 236 on the transfer belt 71. A magnified view of the surface of the gravure rings 77*r*, showing the individual cells 230 in the gravure rings 77*r*, is shown in FIG. 24. As can be seen, each cell 230 generally has the form of an inverted truncated pyramid. Typically, there are about twenty-four pattern lines 230A of cells 230 per centimeter length of gravure ring 77*r*. The particular gravure pattern shown in FIG. 24 is not essential and can be changed as desired to alter the distribution of adhesive within the adhesive stripes 236. Alternatively, depending on the intended use of the adhesively coated sheets, the adhesive can be transfer coated across the entire width of the transfer belt 71 rather than in discrete stripes 236.

An adhesive trough 80 is positioned immediately below the gravure roller 77 for supplying adhesive to the surface of a metering roller 81, which then transfers the adhesive to the reverse rotating gravure roller 77. Adhesive is supplied to adhesive trough 80 from an adhesive supply tank 79 by a pump 78. Alternatively, the metering roller 81 may be eliminated and the gravure roller 77 positioned in direct contact with the adhesive in the adhesive trough 80.

One or more doctor blades 82 engage the surface of the gravure roller 77 to remove any excess adhesive from the gravure roller 77 and ensure that the only adhesive on the gravure roller 77 is contained within the gravure ring(s) 77*r*.

This ensures the adhesive will be coated onto the transfer belt 71 as longitudinal stripes 236.

Figure 23:
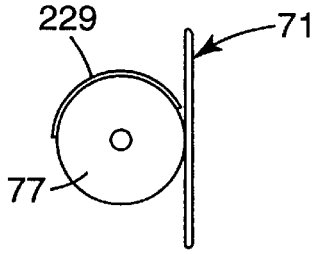
FIG. 23 is a side view of the coating roller and smoothing stripe of FIG. 22.

When a reverse gravure coating process is employed, the uniformity of the adhesive stripes 236 applied to the overlapped sheets (unnumbered) can be improved by smoothing the layer of adhesive applied to the gravure rings 77*r* before the adhesive is transferred to the transfer belt 71. As shown in FIGS. 22 and 23, the adhesive layer on the gravure roller 77 can be smoothed with smoothing strips 229 which are positioned proximate the gravure roller 77 for contacting the adhesive applied to the gravure rings 77*r* as the adhesive is transferred on the gravure roller 77 from the metering roller 81 to the transfer belt 71. The smoothing strips 229 can be pivoted relative to the gravure roller 77 for contacting the adhesive applied to the gravure rings 77*r* before the adhesive is transferred to the transfer belt 71. The smoothing strips 229 are preferably constructed from a flexible polymeric material, and most specifically a strip of polyester which is approximately 0.0011 inches thick.

In some applications, smoothing of the adhesive applied to the gravure roller 77 before the adhesive is applied to the transfer belt 71 can enhance distribution of the microspheres contained in a repositionable microsphere adhesive. In other words, when a smoothed microsphere adhesive is coated onto the overlapped sheets, the uniformity of the exposed surface of the adhesive stripes 236 is improved with the beneficial effect of providing adhesive stripes 236 which provide greater control and uniform adhesive strengths.

Die Coater

The adhesive transfer station 7 shown in FIG. 25, depicts the use of a coating die 242 to apply the pressure-sensitive adhesive to the transfer belt 71. Each coating die 242 has a die slot (not shown) directed towards the transfer belt 71, through which an adhesive stripe 236 is applied to the transfer belt 71. As shown in FIG. 26, a plurality of coating dies 242 are spaced across the width of the transfer belt 71 and positioned at the desired locations of the adhesive stripes 236. Each coating die 242 has a suitable adhesive supply line 245, and accompanying pump 246 and filter 247, through which adhesive is supplied to the coating die 242 from an adhesive reservoir 248. Alternatively, a single coating die 242 may be provided with a divided slot for applying adhesive in several separate locations across the width of the transfer belt 71.

The rate at which adhesive is coated onto the transfer belt 71 is readily adjusted by changing the speed of the pumps 246 which are otherwise driven under the control of the central electronic control unit (not shown) of the apparatus in dependence on the line speed of the apparatus.

Die coating of the adhesive stripes 236 increases the flexibility of the coating process by enabling the location of the coating die heads 242 to be quickly and easily adjusted relative to the transfer belt 71.

Alternatively, as shown in FIG. 19, the overlapped sheets (unnumbered) can be arranged to provide a relatively small length of surface exposed to the adhesive coated transfer belt 71 and the adhesive coating system 74 configured and arranged to coating the entire length and width of the transfer surface 76. In that case, by providing a large degree of overlap between adjacent sheets, as illustrated in FIG. 19, each sheet will be coated with adhesive along a narrow margin 99 along one edge only of the sheets. The sheets can then be stacked to form a pad, with the sheets held together along the adhesive-coated margin 99.

Adhesive Dryer

The adhesive coating (not shown) on the transfer belt 71 is at least partially dried by the adhesive dryer 75. For instance, the moisture content of suitable aqueous adhesives is commonly between about 50 to 80 wt % when applied and is preferably dried by the adhesive dryer 75 to a moisture content of between about 0 to 50 wt %. Preferably, substantially all of the moisture is removed during the drying process. The dried adhesive adheres more readily to the overlapped sheets.

The adhesive dryer 75 is preferably a radio-frequency dryer, for example a particularly adapted version of the Model No. SPW 12-73 manufactured by Proctor Strayfield Ltd. of Berkshire, England operated, typically, at about 27 MHz, or alternatively, at about 30 MHz. The adhesive dryer 75 is about 2.5 m long in the direction of travel of the transfer belt 71 and has an exhaust (not shown) through which the interior of the adhesive dryer 75 is vented with the aid of an exhaust fan 84. The adhesive dryer 75 is provided with a control unit (not shown) which adjusts the power of the adhesive dryer 75 in accordance with the line speed of the coating apparatus. That control unit may, for example, be a Siemens PLC 55-95U interconnected with the central electronic control unit for the entire apparatus.

Use of a radio frequency adhesive dryer 75 permits the adhesive to be dried without significantly heating the transfer belt 71. This eliminates the undesired transfer of heat from the transfer belt 71 to the adhesive coating system 74 where it tends to coagulate the adhesive before it can be applied to the transfer belt 71. Use of a radio frequency adhesive dryer 75 also offers the advantages of comparative simplicity and lower energy consumption. Further, the adhesive transfer station 7 does not require any prolonged preheating and the adhesive is readily released from the transfer belt 71 to the overlapped sheets at the transfer location 70.

The use of a radio-frequency adhesive dryer 75 is preferred, but not essential. The adhesive could, instead, be dried using infra-red or forced air heating systems. However, a radio-frequency dryer is preferred for a number of reasons, including its simplicity, lower energy consumption, reduced thermal build-up, etc. In addition, should the adhesive dryer 75 appreciably heat the transfer belt 71, it may be necessary to incorporate a cooling system (not shown) into the adhesive transfer station 7 for purposes of cooling the adhesive transfer belt 71 in order to reduce the risk of coagulating the adhesive.

The adhesive dryer 75 is provided with a control unit (not shown) for automatically adjusting the power of the adhesive dryer 75 in accordance with the line speed of the transfer belt 71. A suitable control unit is available from Siemens under the designation PLC 55 95U. The control unit can be interconnected with the central electronic control unit for the entire system, for purposes of sending and receiving the information necessary to properly monitor and control operation of the system.

The dried adhesive coating is then transported to the transfer location 70 where the adhesive is transferred from the transfer belt 71 to the overlapped sheets.

Transfer Location

A drive roller 90 and idler counter-pressure roller 91 form a transfer nip 85 at the transfer location 70. The adhesive coated transfer belt 71 and the succession of overlapped sheets pass through the transfer nip 85 wherein the dried adhesive on the transfer belt 71 is transferred to the first major surface of the overlapped sheets due to the greater bonding strength between the adhesive and the overlapped sheets relative to the bonding strength between the adhesive and the transfer belt 71.

As shown in FIG. 16, the idler counter-pressure roller 91 is provided with a plurality of laterally spaced circumferential grooves 92, and a plurality of fingers 93 positioned immediately downstream of the idler counter-pressure roller 91 and engaged within the grooves 92 for ensuring that the overlapped sheets 86 continue to travel with the transfer belt 71 after exiting the transfer location 70 and do not wrap around the idler counter-pressure roller 91.

Vacuum Belt

As shown in FIG. 16, the overlapped sheets 86 are removed from the transfer belt 71 after exiting the transfer location 70 by a vacuum belt 95. Removal of the overlapped sheets 86 from the transfer belt 71 is facilitated by the fact that the trailing edge portion of each sheet is positioned between the leading edge portion of the succeeding sheet 23 and the transfer belt 71. This facilitates initiation of the removal process since removal of the trailing edge portion of each sheet will inherently cause the leading edge portion of the succeeding sheet 23 to be pulled from the transfer belt 71.

The vacuum belt 95 may be selected from a number of commercially available types and styles, such as the system available from Honeycomb Systems Valmet S.a.r.l. of Mulhouse, France, which combines a metallic belt which is entrained around and surrounds a vacuum roller at the leading edge of the metallic belt.

An additional roller 97 is provided between the drive roller 90 and the lowermost downstream tension roller 72 to engage the inside of the transfer belt 71 downstream from the front end (unnumbered) of the vacuum belt 95. The additional roller 97 is positioned relative to the drive roller 90 and downstream tension roller 72 so as to cause the transfer belt 71 to angle away from the front end of the vacuum belt 95 at a small angle of about two to three degrees upstream from the additional roller 97, and thereafter angle away from the vacuum belt 95 at a greater angle of about five degrees. More specifically, the transfer belt 71 should angle away from the vacuum belt 95 at an angle of about two to three degrees for a distance of about 50 mm to permit the suction exerted by the vacuum belt 95 to attract and remove the overlapped sheets from the transfer belt 71, and thereafter at an angle of about five degrees in order to increase the distance between the transfer belt 71 and the adhesively coated sheets. The additional roller 97 is preferably movable between a first and second position as indicated generally by pivot line 97*p*, in order to enable the initial and final angles between the transfer belt 71 and the vacuum belt 95 to be adjusted as necessary to maximize operation of the process.

Figure 17:
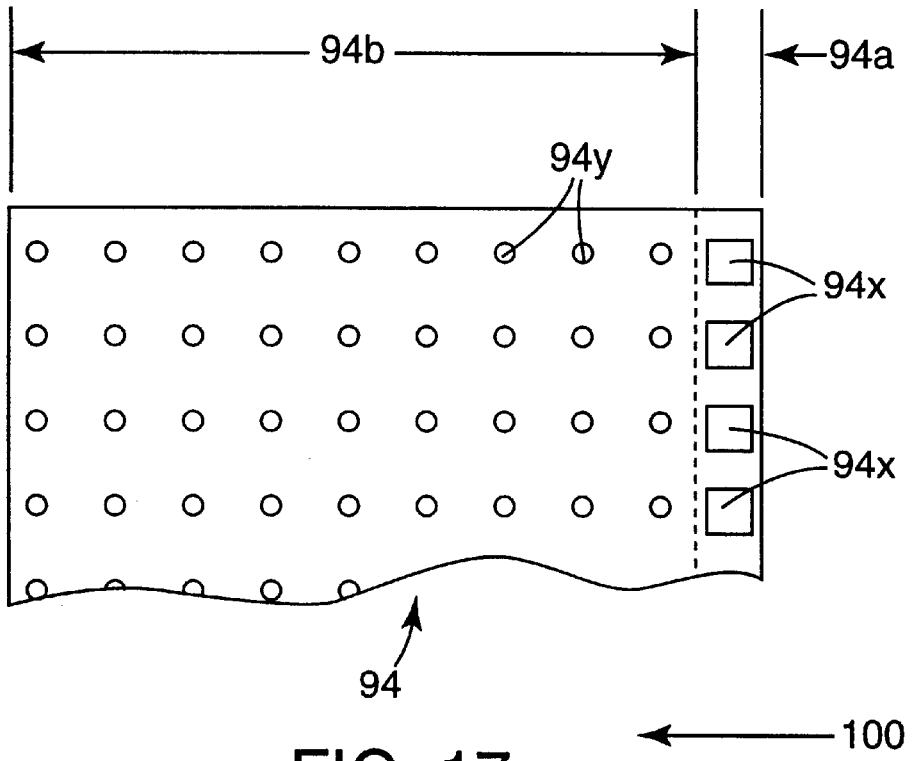
FIG. 17 is an enlarged partial plan view of the vacuum box (94) shown in FIG. 16.
Figure 18:
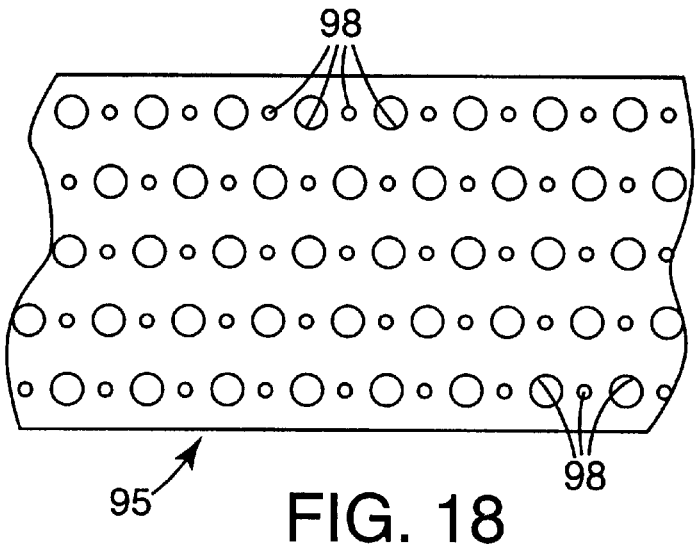
FIG. 18 is an enlarged partial plan view of the vacuum belt (95) shown in FIG. 16.

Referring to FIGS. 17 and 18, a vacuum belt 95 rests upon a vacuum box 94 which is connected to a source of low pressure (not shown). The vacuum box 94 is divided into a forward chamber 94*a* and a rear chamber 94*b*, with the forward chamber 94*a* connected to a first source of low pressure (not shown) and the rear chamber 94*b* connected to a second source of low pressure (not shown). The first source of low pressure pulls a vacuum which is greater then the vacuum pulled by the second source of low pressure. The greater vacuum pulled in the forward chamber 94*a* facilitates removal of the adhesive coated sheets from the transfer belt 71 as the sheets exit the transfer location 70. In order to further facilitate the greater initial suction required on the vacuum belt 95, the openings 94*x* in the top (unnumbered) of the forward chamber 94*a* are larger than the openings 94*y* provided in the rear chamber 94*b*.

The vacuum belt 95 also includes a plurality of apertures 98 so that the reduced pressure applied to the back side (unnumbered) of the vacuum belt 95 through the top of the vacuum box 94 will communicate through the vacuum belt 95 and interact with any sheets positioned on the upper surface of the vacuum belt 95. The reduced pressure applied by the low pressure source through the vacuum belt 95 is comparatively strong over the initial length (unnumbered) of the vacuum belt 95, and is then decreased over the remaining length of the belt 95. The initial vacuum must be sufficient to detach the overlapped sheets and accompanying adhesive strips from the transfer belt 71 without damaging the sheets. Once the overlapped sheets and accompanying adhesive have been delaminated from the transfer belt 71, the vacuum need only maintain the detached sheets on the vacuum belt 95. While the acceptable and optimal reduced pressure levels depends upon a number of factors, including the specific type of adhesive being applied and the characteristics of the sheet material being coated, an initial reduced pressure in the range of from 350 to 550 mm $H_2O$ (typically 400 mm $H_2O$) will generally be acceptable, with a reduced pressure in the range of from 150 to 200 mm $H_2O$ generally acceptable over the remainder of the run.

The vacuum belt 95 may be configured as a single belt covering the entire width of the vacuum box 94, or a plurality of narrower belts arranged side-by-side across the width of the vacuum box 94.

Once detached from the vacuum belt 95, the sheets may be stacked and trimmed to form pads of repositionable notes, for example those available under the designation Post-It® notes available from the Minnesota Mining and Manufacturing Company of St. Paul, Minn.

Figure 21:
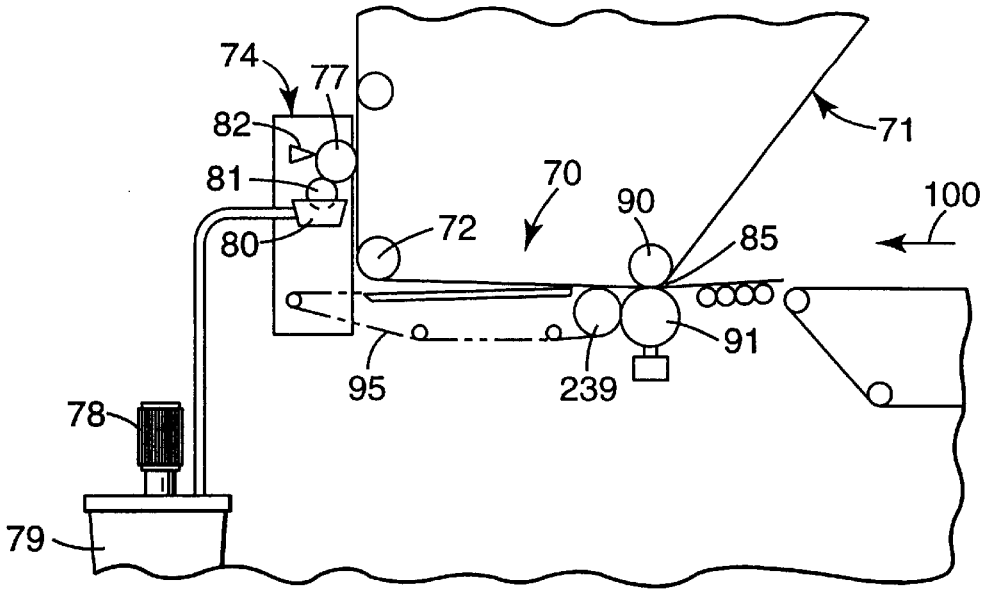
FIG. 21 is a diagrammatic side view of a portion of a second embodiment of an adhesive transfer station.

The particular sheet removal system described herein and illustrated in FIGS. 15 and 16 is not essential, and can be replaced by other suitable systems, such as (i) mechanical grippers (not shown), (ii) a vacuum roller 239 to detach the overlapped sheets from the transfer belt 71 combined with a separate standard conveyor 96 to transport the detached sheets to the desired location, as shown in FIGS. 21 and 25, or (iii) the vacuum roller 239 combined with a separate vacuum belt 95. However, such other systems would not provide the benefits associated with the system described herein and illustrated in FIGS. 15 and 16.

The sheet removal systems described herein could also be used with other sheet coating apparatuses other than the specific apparatus described herein.

Adhesive

The adhesive may be substantially any pressure-sensitive adhesive. When producing repositionable notes, such as Post-It® notes, the adhesive is preferably a repositionable, microsphere, pressure-sensitive adhesive such as those described in U.S. Pat. Nos. 5,045,569; 4,495,318, 4,166,152, 3,857,731, 3,691,140, Reissue 24,906 and European Patent Publication 439,941. Other suitable adhesives include film-forming materials known in the art, including those containing organic solvents.

Sheet Stacking Station

As shown in FIG. 5, the adhesive coated sheets (unnumbered) exiting the adhesive transfer station 7 are transported to a sheet stacking station 9 where the adhesive coated sheets are stacked 140 and prepared for cutting into note pads of the desired size and shape.

Secondary Sheet Inserting Station

As shown in FIG. 5, a secondary sheet inserting station 150 can be positioned between the adhesive coating station 7 and the sheet stacking station 9 for periodically inserting sheets, such as backer sheets, into the paper path just prior to stacking of the sheets.

The Sheets

Although the apparatus has been described in connection with the coating of paper sheets, the apparatus is capable of coating sheets constructed from other materials, such as polymeric films and metallic foils.

Papers of different sizes, weights and textures can be used if desired. For example, the described apparatus is readily adaptable to handle sheets of A2 and A4 size paper. Likewise, the apparatus is able to handle sheets of a comparatively high weight (e.g. 90 gsm) as well as sheets of a low weight (e.g., 70 gsm).

Operation

The Sheet Feeding Station

The suction head 12 lifts the rear edge (unnumbered) of the top sheet (unnumbered) from the stack 11 and moves the lifted sheet forward. Movement of the lifted sheet is assisted by a jet of air from jet nozzle 12*a*. The lifted sheet is then taken up by the paired feed rollers 13 and conveyed out of the sheet feeding station 1 and onto a first conveyor 14. The suction head 12 returns to its original position, picks up the next sheet, and feeds the next sheet to the paired feed rollers 13 before the first sheet is fed completely through the paired feed rollers 13. In that way, the trailing edge (not shown) of each sheet overlaps the leading end (not shown) of the succeeding sheet 23 as the sheets pass between the paired feed rollers 13 and are fed onto the first conveyor 14.

As the height of the stack 11 decreases, the table 10 moves upwards to maintain the top (unnumbered) of the stack 11 in a predetermined vertical location relative to the suction head 12.

The First Conveyor and Stop Gate

Sheets exiting the sheet feeding station 1 are deposited on the first conveyor 14 and transported to the stop gate 15 at the entry to the dual coating station 3. As each sheet arrives at the stop gate 15, its forward progress is temporarily halted while the coating drum 33 rotates to the correct position for transporting and coating the sheet. The stop gate 15 then opens to allow a single accumulated sheet to enter the dual coating station 3. The stop gate 15 then closes in advance of the arrival of a succeeding sheet 23 and temporarily halts the forward progress of that sheet until the coating drum 33 has once again rotated to the correct position.

The Dual Coating Station

Stop gate 15 releases a sheet into the dual coating station 3 in timed relationship to the rotational position of the coating drum 33, with a sheet fed into the dual coating station 3 on every rotation of the coating drum 33. The pad 38 on the coating drum 33 contacts the lower coating roller 35 and is coated with LAB. As the LAB coated pad 38 approaches the upper coating roller 32, a sheet is fed through the nip roll pair 30 and the leading edge of the sheet picked up by the sheet gripper 37. The sheet is carried through the coating nip formed between the upper coating roller 32 and the pad 38 on the coating drum 33 and is coated on a first major surface with primer. The force of the coating nip also causes the LAB coating on the pad 38 to transfer to the second major surface of the sheet. The dual coated sheet is then released by the sheet gripper 37 and removed from the coating drum 33 by a clasp 52. This procedure is repeated for each sheet fed into the dual coating station 3.

In the event that no sheet is waiting at the stop gate 15, that fact is detected by a photocell (not shown) positioned at the stop gate 15, and the upper coating roller 32 is moved away from the coating drum 33 to prevent any mixing of the primer and LAB materials.

The Sheet Spacing Station

Sheets exiting the dual coating station 3 enter the sheet spacing station 4 in which a clasping unit 50 is positioned to grab the dual coated sheets as they emerge from the coating nip, and deposit them on a second conveyor 51. Movement of the chain 53 is synchronized with rotation of the coating drum 33 so that a clasp 52 is positioned to receive each dual coated sheet as the sheet leaves the coating nip. The LAB coating on the underside of the dual coated sheet is partially dried by a heater (not shown) before it is deposited onto the second conveyor 51.

The speed of the second conveyor 51 relative to the line speed of the chain 53 of the clasping unit 50 determines whether the coated sheets are transported to the drying station 5 as individual sheets or a pseudo-web of overlapped sheets. When the second conveyor 51 is run at a slower speed than the chain 53 of the clasping unit 50, a leading edge portion of each sheet overlaps a trailing edge portion of the preceding sheet 22 and forms a pseudo-web of overlapped sheets on the second conveyor 51. When the second conveyor 51 is run at the same speed or faster than the chain 53 of the clasping unit 50, a gap is maintained between the sheets deposited on the second conveyor 51.

The Overlap Reversal System

When the sheets are fed as a pseudo-web of overlapped sheets, an air knife 60 is timed to direct a discrete jet of air against the overlapped edge portions of each pair of overlapped sheets 22 and 23. This occurs whenever the preceding sheet 22 has just moved onto the third conveyor 56 and the succeeding sheet 23 has just begun to move off the second conveyor 51. The air jet emanating from the air knife 60 causes the trailing edge portion of the preceding sheet 22 and the leading edge portion of the succeeding sheet 23 to be lifted up from the sheet path as shown by the dotted lines in FIG. 13. The trailing edge portion of the preceding sheet 22 comes under the influence of the suction emanating from the vacuum cylinder 61 and is pulled towards the vacuum cylinder 61, where the trailing edge of the succeeding sheet 23 is held against the surface of the vacuum cylinder 61 while the leading edge portion of the succeeding sheet 23 returns to the sheet path. The preceding sheet 22 continues to be conveyed forward by the third conveyor 56, which causes the trailing edge portion of the preceding sheet 22 to slide across the surface of the vacuum cylinder 61 until it slides past the last row of apertures 63 on the vacuum cylinder 61 and returns to the sheet path. The trailing edge portion of the preceding 22 now rests above, rather than below, the leading edge portion of the succeeding sheet 23.

Drying Station

The sheets (either individually or in the form of a pseudo-web of overlapped sheets) is transported by the third conveyor 56 from the sheet spacing station 4 and through the drying station 5 where moisture is removed from the primer and LAB coatings on the sheets. The overlapped sheets are moved continuously through the drying station 5 by the third conveyor 56 and are dried at a rate which attenuates the tendency of the sheets to curl.

Sheet Overlapping Station

When the sheets have been fed individually through the drying station 5, a sheet overlapping station 8 is positioned between the drying station 5 and the adhesive transfer station 7 for overlapping the sheets before they enter the adhesive transfer station 7.

The individual sheets exiting the drying station 5 are taken-up by a pair of input rollers 110 and pass the sheets between a pair of drive rollers 111. The drive rollers 111 transport the sheets to a lever 112. The lever 112 pivots between a first position where the lever 112 projects into the sheets path and stops the forward progress of sheets along the sheet path, and a second position where the lever 112 is positioned below the sheet path so as to allow any accumulated sheets to proceed forward towards the adhesive transfer station 7.

The drive rollers 111 pivot between an open position and a closed position in response to the position of the lever 112 so as to rotate without propelling the sheets forward when the lever 112 is pivoted into the first position, and to propel the sheets forward along the paper path when the lever 112 is pivoted into the second position below the sheet path.

The lever 112 is returned to the first position while a portion of a preceding sheet 22 is still positioned over the lever 112 so that a trailing portion of the preceding sheet 22 is lifted up from the sheet path by the lever 112. The lever 112 is then pivoted to the second position and the drive rollers 111 closed while a trailing edge portion of the preceding sheet 22 is still above the lever 112 so that the trailing edge portion of the preceding sheet 22 will overlap a leading edge portion of the succeeding sheet 23.

Adhesive Transfer Station

The registered and overlapped sheets pass through a transfer location 70 where they contact an endless transfer belt 71 to which an adhesive coating has previously been applied in the form of a plurality of adhesive stripes 236 extending longitudinally along the transfer belt 71 and at least partially dried. The adhesive stripes 236 transfer from the transfer belt 71 to the pseudo-web of overlapped sheets and sheets removed from the transfer belt 71 along with the adhesive stripes 236 by a vacuum belt 95 and/or a vacuum roller 239.

Sheet Stacking Station

The adhesive coated sheets exiting the adhesive transfer station 7 are transported to a sheet stacking station 9 where the adhesive coated sheets are stacked 140 and prepared for cutting into note pads of the desired size and shape.

What is claimed is:

1. A method for producing coated sheets, comprising:

(a) sequentially feeding sheets having first and second major surfaces from a first stack onto a sheet path and continuing to convey the sheets along the sheet path in a machine direction;

(b) inserting at least one sheet having first and second major surfaces from a second stack into the sheets being conveyed along the sheet path to form a sequence of sheets arranged in end-to-end overlapping relationship to each other with the entire sequence of sheets configured and arranged with either (i) a trailing edge of each sheet positioned over a leading edge of a subsequent sheet, or (ii) a trailing edge of each sheet positioned under a leading edge of a subsequent sheet; and (c) individually applying coating material to at least one major surface of each sheet in the overlapped sequence of sheets as the sheets continue to be conveyed along the sheet path so as to form coated sheets.

2. A method of claim 1 in which water-based coating material is applied to both major surfaces of each sheet.

3. The method of claim 2 wherein a primer material is applied to the first major surface of the sheets, and a low adhesion backsize material is applied to the second major surface.

4. The method of claim 2 further including drying the coated sheets as they continue to be conveyed along the sheet path so as to form dry sheets.

5. The method of claim 4 wherein: (i) the dry sheets are arranged in end-to-end overlapping relationship to each other, and (ii) a further coating material is applied continuously to at least one of the major surfaces of the dry sheets as they continue to be conveyed along the sheet path.

6. The method of claim 5 in which the further coating material is an adhesive.

7. The method of claim 6 in which the adhesive is a repositionable adhesive.

8. An apparatus for producing coated sheets, comprising:

(a) a conveyor;

(b) a sheet feeder operable to sequentially feed sheets from a first stack onto the conveyor in end-to-end overlapping relationship to form overlapped sheets;

(c) a sheet inserter operable to insert at least one sheet from a second stack into the overlapped sheets on the conveyor to form an overlapped sequence of sheets with the entire sequence of sheets configured and arranged with either (i) a trailing edge of each sheet positioned over a leading edge of a subsequent sheet or, (ii) a trailing edge of each sheet positioned under a leading edge of a subsequent sheet; and (d) a coating system positioned to receive the overlapped sequence of sheets from the conveyor and operable to (i) separate the sheets, and (ii) apply a coating material to at least one major surface of each separated sheet.

9. The apparatus of claim 8 wherein the coating system is a dual coater operable to apply a water-based coating material to both major surfaces of each sheet.

10. The apparatus of claim 9 further including a dryer positioned to receive sheets from the dual coater and operable to remove water from a coating material applied to the sheets in the dual coater.

11. The apparatus of claim 10 further including: (i) a secondary coater positioned to receive sheets exiting from the dryer and operable to apply a further coating material to at least one major surface of each sheet member, and (ii) a sheet overlapping station located downstream from the dual coater and operable to arrange the sheets in end-to-end overlapping relationship for entry into the secondary coater.

12. The apparatus of claim 11 in which the sheet overlapping station is located upstream from the dryer.

* * * * *